US007946234B2

(12) United States Patent
Nagata et al.

(10) Patent No.: US 7,946,234 B2
(45) Date of Patent: May 24, 2011

(54) SEWING MACHINE

(75) Inventors: Yoshihiro Nagata, Matsue (JP); Takayuki Shiina, Chofu (JP)

(73) Assignee: Juki Corporation, Chofu-shi, Tokyo (JP)

( * ) Notice: Subject to any disclaimer, the term of this patent is extended or adjusted under 35 U.S.C. 154(b) by 1071 days.

(21) Appl. No.: 11/652,819

(22) Filed: Jan. 12, 2007

(65) Prior Publication Data

US 2007/0163477 A1 Jul. 19, 2007

(30) Foreign Application Priority Data

Jan. 16, 2006 (JP) ..... P. 2006-007496
Sep. 26, 2006 (JP) ..... P. 2006-261049

(51) Int. Cl.
*D05B 29/02* (2006.01)
*D05B 29/00* (2006.01)

(52) U.S. Cl. ..... 112/237

(58) Field of Classification Search ..... 112/235–240, 112/303, 310–320, 220, 221
See application file for complete search history.

(56) References Cited

U.S. PATENT DOCUMENTS 4,341,172 A * 7/1982 Thompson ..... 112/310
4,449,464 A * 5/1984 Porter ..... 112/311
4,981,094 A * 1/1991 Stapel et al. ..... 112/235
5,309,854 A * 5/1994 Mulcahey et al. ..... 112/314
5,678,502 A * 10/1997 Mulcahey et al. ..... 112/475.08
6,499,415 B1 * 12/2002 Grant et al. ..... 112/443

FOREIGN PATENT DOCUMENTS

JP 2004-57822 2/2004

* cited by examiner

*Primary Examiner* — Ismael Izaguirre
(74) *Attorney, Agent, or Firm* — Merchant & Gould P.C.

(57) ABSTRACT

A sewing machine includes a needle, a needle bar which supports the needle, an upper feeding foot operable to feed the workpiece interlockingly with an up and down movement of the needle bar, a presser foot operable to press the workpiece, a holding bar which supports the presser foot, an actuator including an operating member operable to be changed to a first state, a second state or a no-load state, and a connecting portion which couples the operating member and the holding bar. The holding bar is constantly biased downward by a biasing force. The actuator moves the presser foot up against the first biasing force when the operating member is in the first state, and moves the presser foot down when the operating member is in the second state.

6 Claims, 21 Drawing Sheets

PRIOR ART

PRIOR ART

PRIOR ART

SEWING MACHINE

The present invention claims priority from Japanese patent applications no. 2006-007496 filed on Jan. 16, 2006, and No. 2006-261049 filed on Sep. 26, 2006, the entire contents of which are incorporated herein by reference.

BACKGROUND OF THE INVENTION

1. Field of the Invention

The present invention relates to a sewing machine for sewing a workpiece while feeding the workpiece with an upper feeding foot, a presser foot, and feeding teeth.

2. Description of the Related Art

In a sewing machine, as shown in FIG. 21A, when a needle 101 moves down and pierces a workpiece, an upper feeding foot 104 moves down at the same time. The upper feeding foot 104 holds the workpiece with feed teeth 105 which move up in its substantially elliptical oscillation motion.

Next, as shown in FIG. 21B, when the upper feeding foot 104 presses the workpiece, a presser foot 106 which previously presses the workpiece starts to move up from the workpiece. At this time, the needle 101 piercing the workpiece, and the upper feeding foot 104 and the feeding teeth holding the workpiece oscillate in a left direction of the drawing, whereby the workpiece is fed in the left direction.

As shown in FIG. 21C, when the upper feeding foot 104 and the feeding teeth 105 finishes to cooperatively feed the workpiece, the needle 101 moves up and starts to be drawn from the workpiece. At the same time, the presser foot 105 moves down and presses the workpiece.

As shown in FIG. 21D, simultaneously with the presser foot 106 pressing the workpiece, the upper feeding foot 104 and the feeding teeth 105 start to leave from the workpiece. In the meantime, the needle 101, the upper feeding foot 104 and the feeding teeth 105 oscillate and leaves from the workpiece, thereby returning to their initial positions as shown in FIG. 21A. The workpiece is fed by repeating these operations.

In starting a sewing operation, a thread needs to be drawn to a back side of the workpiece. However, if the thread is stepped on by the presser foot 106, it is difficult to draw the thread. For this reason, the presser foot 106 is moved up when starting the sewing operation in order to easily draw the thread. More specifically, as shown in FIG. 22 and FIG. 23, the presser foot 106 is held by a holding bar 107. An upper portion of the holding bar 107 is connected to a holding bar bracket 108, and is engaged with a spring 111. A front end portion of a lift lever 109 comes in contact with a lower face of one end portion of the holding bar bracket 108. The lift lever 109 is substantially in an L shape, and moves up the holding bar 107 and the presser foot 106 by lifting the holding bar bracket 108. A corner portion of the lift lever 109 is rotatably supported so that the front end portion of the lift lever 109 moves up and down. An air cylinder 110A is connected to a base end portion of the lift lever 109, and the lift lever 109 rotates around the corner portion by moving a piston rod of the air cylinder 110 back and forth. When the piston rod of the air cylinder 110 moves forward from a state shown in FIG. 22, the lift lever 109 rotates in a clockwise direction, whereby the presser foot 106 moves down by a biasing force of the spring 111 and changes to a state shown in FIG. 23. On the other hand, when the piston rod of the air cylinder 110 moves rearward from the state shown in FIG. 23, the lift lever 109 rotates in a counterclockwise direction and changes to the state shown in FIG. 22, whereby the presser foot 106 moves up. Namely, the presser foot is prevented from stepping on the thread when drawing the thread by moving the piston rod of the air cylinder 110 back and forth at a timing of starting the sewing operation.

When a thickness of the workpiece varies, a height where the presser foot 106 presses the workpiece varies. When there is such a variation, even if the lift lever 109 is rotated in the clockwise direction so as to be moved back to its initial position by moving the piston rod of the air cylinder 110 forward after the thread is drawn by a shuttle, depending on the thickness of the workpiece, there is a case in which the presser foot 106 is not moved down to its initial position, whereby a gap L is generated between the lift lever 109 and the holding bar bracket 108.

When there is such a gap L, a time loss is caused between operations of the air cylinder 110 and the presser foot 106, resulting in a variation in timings of moving up the presser foot. In order to solve this problem, a potentiometer may be attached to the lift lever 109 so that a rotational angle of the lift lever 109 is detected by the potentiometer. If the air cylinder 110 is controlled based on a result of the detection, the gap L can be compensated and the presser foot can be moved up at optimum timings (see, e.g., JP-A-2004-057822).

However, in recent years, in view of restraining a manufacturing cost, a reduction in the number of components and an improvement in controlling efficiency are desired. This is not exceptional for a structure with regard to the moving up operation of the presser foot. For example, if the moving up operation of the presser foot with stabilized timings can be realized without the potentiometer, the structure and the control can be simplified.

SUMMARY OF THE INVENTION

It is an object of the present invention to provide a sewing machine in which a thread is reliably drawn to a back side of a cloth when starting a sewing operation in accordance with a change in a thickness of a workpiece.

According to a first aspect of the invention, a sewing machine includes: a needle operable to penetrate a workpiece on a throat plate and operable to form a stitch with a shuttle; a needle bar which supports the needle at a lower end thereof and operable to move up and down; an upper feeding foot operable to contact with the workpiece from above and operable to feed the workpiece interlockingly with an up and down movement of the needle bar; a presser foot operable to press the workpiece; a holding bar which supports the presser foot at a lower end portion thereof, the holding bar being constantly biased downward by a first biasing force; an actuator including an operating member operable to be changed to a first state, a second state or a no-load state; and a connecting portion which connects the operating member and the holding bar. The actuator moves the presser foot up against the first biasing force when the operating member is in the first state, and moves the presser foot down when the operating member is in the second state.

According to a second aspect of the invention, the sewing machine set forth in the first aspect of the invention may further include a control portion operable to control the operating member. When a sewing starts, the control member brings the operating member into the no-load state. When the needle penetrates through the workpiece and forms a first stitch, the control member brings the operating member into the first state for a predetermined time period, and thereafter, brings the operating member into the second state.

According to a third aspect of the invention, a sewing machine includes: a needle operable to penetrate a workpiece on a throat plate and operable to form a stitch with a shuttle;

a needle bar which supports the needle at a lower end thereof and operable to move up and down; an upper feeding foot operable to contact with the workpiece from above and operable to feed the workpiece interlockingly with an up and down movement of the needle bar; a presser foot operable to press the workpiece; a holding bar which supports the presser foot at a lower end portion thereof, the holding bar being constantly biased downward by a first biasing force; an actuator including an operating member operable to be changed to a first state, a second state or a no-load state; a connecting portion operable to connect the operating member and the holding bar, and a gap is provided in a connecting path of the connecting portion; and an biasing member which applies a second biasing force in a direction of reducing the gap. The second biasing force is smaller than the first biasing force. The actuator moves the presser foot up against the first biasing force when the operating member is in the first state, and the presser foot is moved down by the first biasing force when the operating member is in the second state.

According to a fourth aspect of the invention, the sewing machine set forth in the third aspect of the invention may further include a control portion operable to control the operating member. When a sewing starts, the control member brings the operating member into the no-load state. When the needle penetrates through the workpiece and forms a first stitch, the control member brings the operating member into the first state for a predetermined time period, and thereafter, brings the operating member into the second state.

According to a fifth aspect of the invention, the biasing member set forth in the third aspect of the invention includes an elastic member.

According to the first aspect of the invention, the connecting portion connects the actuator and the presser foot. Therefore, when the actuator is in a neutral state, the operating member of the actuator is brought into the no-load state, whereby the operating member can be positioned in accordance with a thickness of the cloth. As a result, the presser foot is positioned in accordance with the thickness of the cloth, thereby making it possible to reliably draw an upper thread end to a back side of the cloth at the time of starting a sewing operation by a simple structure.

According to the third aspect of the invention, due to the biasing member being provided, the operating member of the actuator is brought into the no-load state when the actuator is in the neutral state, whereby a gap in the connecting portion is closed by a biasing force (the second biasing force) of the biasing member, and the operating member can be positioned in accordance with a thickness of the cloth. As a result, the presser foot is positioned in accordance with the thickness of the cloth, thereby making it possible to reliably draw an upper thread end to a back side of the cloth at the time of starting a sewing operation by a simple structure.

According to the second and the fourth aspects of the invention, the upper thread end can reliably be drawn to the back side of the cloth at the time of starting a sewing operation only by controlling the operating member so as to be in the no-load state (the actuator is brought into the neutral state), the first state, and the second state.

According to the fifth aspect of the invention, the biasing member (the elastic member) biases to move one end portion of the actuator in the direction of moving the holding bar up when the actuator is in the neutral state, whereby the gap is closed and the connecting portion is brought into a coupled state.

According to the above aspects of the invention, the upper thread end can reliably be drawn to the back side of the cloth when starting a sewing operation by a simple structure without a potentiometer.

DETAILED DESCRIPTION OF THE EMBODIMENTS

Hereinafter, embodiments of the invention will be explained with reference to the drawings, the following embodiments do not limit the scope of the invention.

First Embodiment

Figure 1:
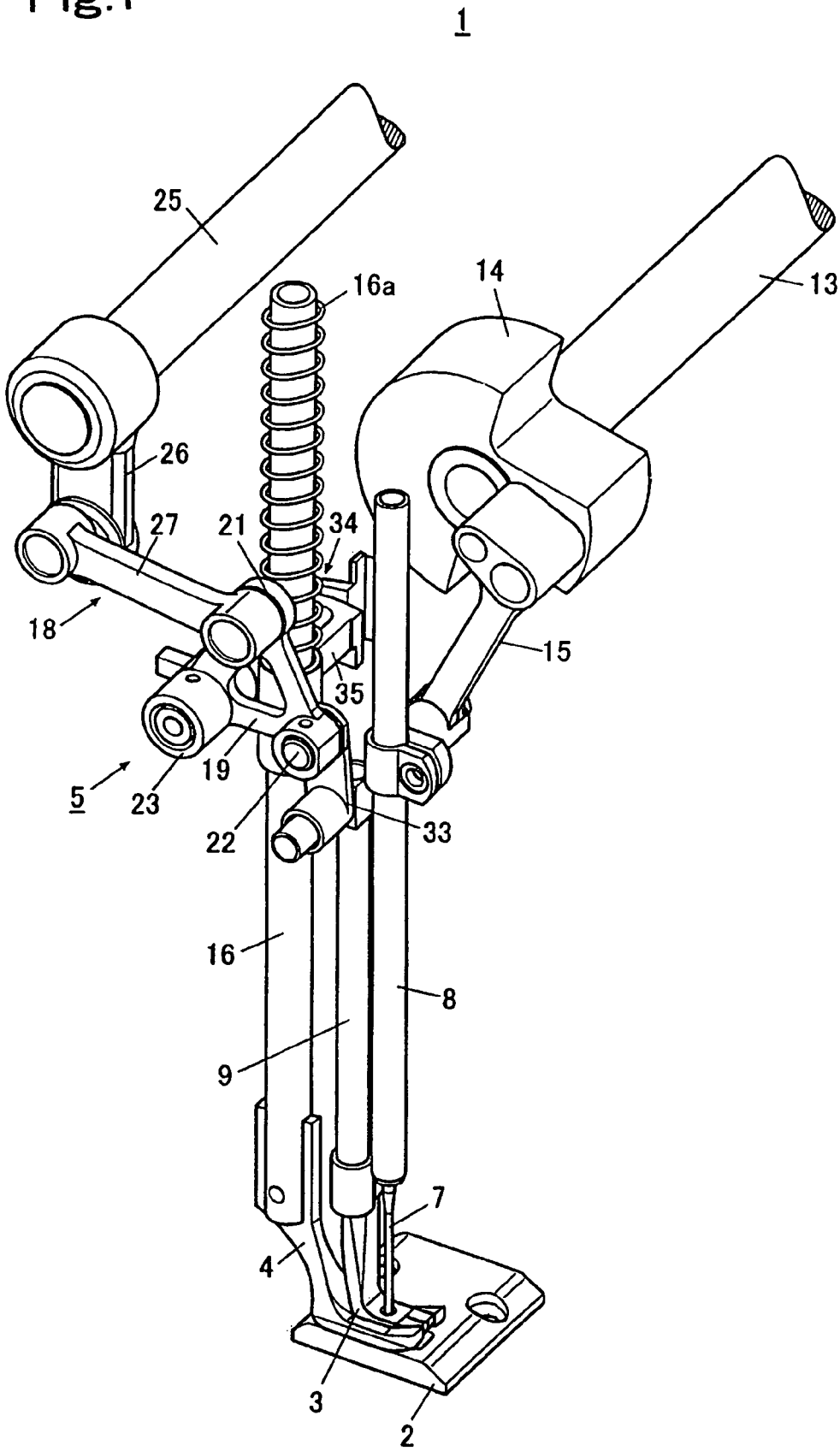
FIG. 1 is a perspective view showing a vicinity of a needle bar of a sewing machine according to a first embodiment.
Figure 2:
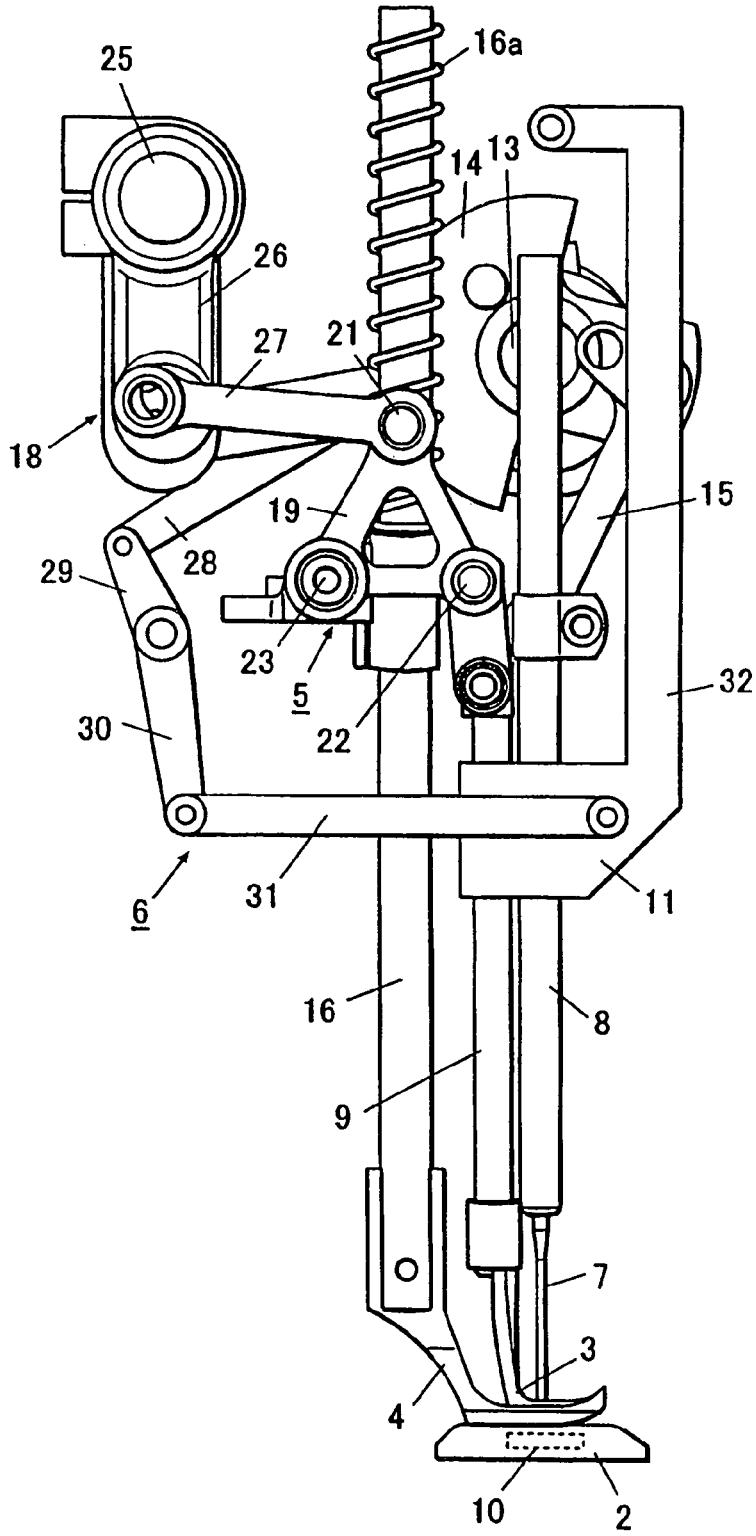
FIG. 2 is a side view showing the vicinity of the needle bar shown in FIG. 1.
Figure 3:
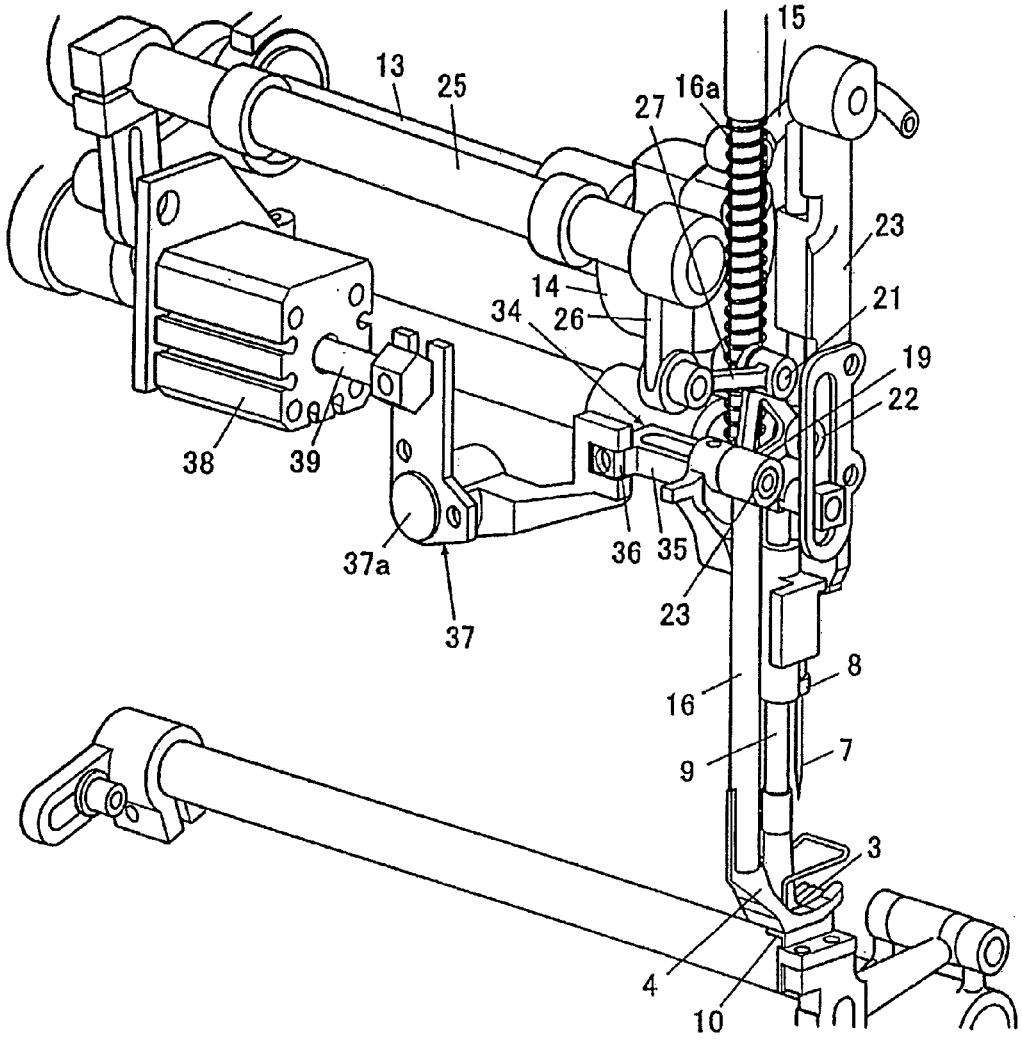
FIG. 3 is a perspective view showing a vicinity of an air cylinder of the sewing machine shown in FIG. 1.

As shown in FIG. 1 through FIG. 3, a sewing machine 1 includes an upper feeding foot 3 operable to contact with a workpiece on a throat plate from above and operable to move in a cloth feeding direction so as to a feed the workpiece, a presser foot 4 operable to press the workpiece toward the throat plate 2 from above, a first operating mechanism 5 operable to move the upper feeding foot 3 and the presser foot 4 such that the upper feeding foot 3 and the presser foot 4 vertically reciprocate in opposite phases, and a second operating mechanism 6 operable to move the upper feeding foot 3 such that the upper feeding foot 3 reciprocates in the cloth feeding direction.

The upper feeding foot 3 is supported by a supporting bar 9 which extends in a vertical direction to be in line with a longitudinal direction of a needle bar 8. The needle bar 8 holds a needle 7 at a lower end thereof. The upper feeding foot 3 is operable to press the workpiece placed on the throat plate 2 from above, and operable to feed the workpiece in the cloth feeding direction by holding the workpiece with feeding teeth 10 projects above the throat plate 2 from a lower side of the throat plate 2 at a predetermined timing. The upper feeding foot 3 is formed with an insertion hole 12 through which the needle 7 can be inserted.

The needle bar 8 is connected to an eccentric cam 14 via a link 15. The eccentric cam 14 is provided at a front end of an upper shaft 13. The needle bar 8 moves in a vertical direction in accordance with a rotation of the upper shaft 13 around its axis. The needle bar 8 is disposed such that a longitudinal direction thereof is in line with a vertical direction and is arranged substantially in parallel with the upper feeding foot 3.

The presser foot 4 is arranged to align with the upper feeding foot 3 in the cloth feeding direction, and is supported by a holding bar 16 which extends in a vertical direction. The presser foot 4 is operable to press the workpiece on the throat plate 2 from above. A front end of the presser foot 4 is bent so as to extend in a face direction of the throat plate 2. A portion of the front end of the presser foot 4 where the workpiece is pressed onto the throat plate 2 is bifurcated.

The first operating mechanism 5 includes a connecting member 19 connected to an oscillation mechanism 18. As shown in FIG. 2, the connecting member 19 is formed substantially in a triangular shape. In the connecting member 19, one apex portion thereof disposed on an upper side is rotatably connected to the oscillation mechanism 18 as a first connecting position 21. In the remaining two apex portions of the connecting member 19, an apex portion disposed on an upstream side of the cloth feeding direction is a second connecting position 22, and an apex portion disposed on a downstream side thereof is a third connecting position 23. The second connecting position 22 is connected to the supporting bar 9 via a link member 33, and the third connecting position 23 is connected to the holding bar 16. The holding bar 16 is provided with a coupling member 34 connected to the third connecting position 23 and a spring 16*a*. The holding bar 16 moves up and down by a power of the oscillation mechanism 18 transmitted to the coupling member 34 via the connecting member 19. The spring 16*a* applies a biasing force (first biasing force) to the holding bar 16 so as to move the holding bar 16 down.

The coupling member 34 includes an extended portion 35 extending to a left side shown in FIG. 3. The extended portion 35 supported by a sewing machine frame so as to be able to move up and down. A rotatable square block 36 is attached to the extended portion 35.

A corner portion 37*a* of a lift lever 37 is axially supported by the sewing machine frame so that the lift lever 37 is rotatable. One end portion of the lift lever 37 is formed substantially in a C-shape so as to be fitted to the square block 36, and the other end portion thereof is connected to a piston rod 39 of an air cylinder 38. In this way, the lift lever 37 is connected to the holding bar 16 via the square block 36 and the coupling member 37 in a state of being supported by the sewing machine frame. Therefore, the coupling member 34 moves up and down in accordance with rotating movement of the lift lever 37, thereby moving the holding bar 16 up and down. According to the first embodiment, a connecting portion that connects the piston rod (operating member) 39 of the air cylinder (actuator) 38 and the holding bar 16 in a coupling state includes the square block 36, the coupling member 34, and the lift lever 37.

As shown in FIG. 1 through FIG. 3, the oscillation mechanism 18 is connected to the upper shaft 13 that is driven to rotate by a motor 24 (see, FIG. 6), and transmits a drive force of the motor 24 to the first operating mechanism 5 via the upper shaft 13. Specifically, the oscillation mechanism 18 includes a rotating shaft 25 connected to the upper shaft via an eccentric cam (not illustrated), a transmission link 26 connected to one end of the rotating shaft 25, and a rotation link 27 one end of which is rotatably connected to the transmission link 26 and the other end of which is rotatably connected to the first connecting position 21 of the connecting member 19.

The transmission link 26 is arranged such that a longitudinal direction thereof is in line with a vertical direction. The rotation link 27 is arranged such that a longitudinal direction thereof is orthogonal to the transmission link 26.

The second operating mechanism 6 is operable to move the upper feeding foot 3 and the needle bar 8 such that the upper feeding foot 3 and the needle bar 8 reciprocate in the cloth feeding direction, As shown in FIG. 2, the second operating mechanism 6 includes a transmitting member 28 connected to the upper shaft 13 via an eccentric cam (not illustrated), a first lever 29 rotatably connected to the transmitting member 28, a second lever 30 rotatably connected to the first lever 29, a tension member 31 rotatably connected to the second lever 30, and a rotating frame 32 rotatably connected to the tension member 31. A lower end portion of the rotating frame 32 is provided with a supporting portion 11 which supports the upper feeding foot 3 and the needle bar 8 in the vicinity of a portion where the tension member 31 is connected. An upper end portion of the rotating frame 32 is rotatably supported by the sewing machine frame (not illustrated).

Figure 4:
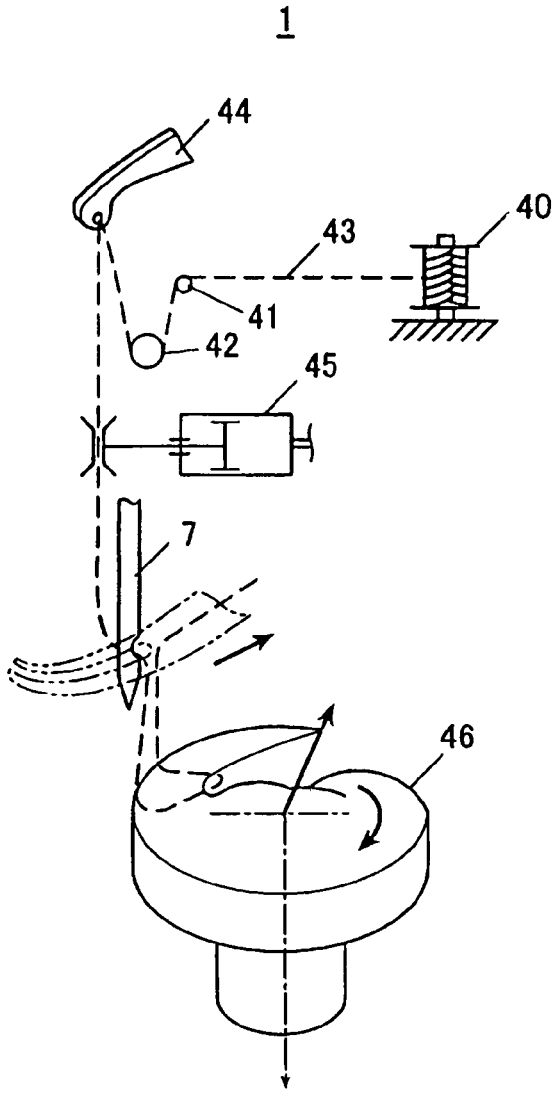
FIG. 4 is an explanatory view showing a bobbin, a thread take-up, a shuttle of the sewing machine shown in FIG. 1.

As shown in FIG. 4, the sewing machine 1 is provided with a bobbin 40 on a sewing machine frame. An upper thread 43 drawn from the bobbin 40 reaches the needle 7 via a guide roller 41, a nip roller 42, and a thread take-up 44. The sewing machine 1 further includes a clamping portion 45 arranged between the thread take-up 44 and the needle 7 in order to clamp the upper thread 43. A lower side of the throat plate 2 is arranged with a shuttle 46 operable to catch the upper thread 43 which comes inside the throat plate 2 by the needle 7.

The clamping portion 45 includes a straight moving device such as an air cylinder or a solenoid.

The shuttle 46 is operable to rotate interlockingly with the upper shaft 13 and is operable to catch the upper thread 43 when the upper shaft 13 is rotated at a predetermined rotational angle. The upper shaft 13 is attached with an encoder 47 (See, FIG. 6) operable to detect a rotational angle where the shuttle 46 catches the upper thread 43.

Figure 5:
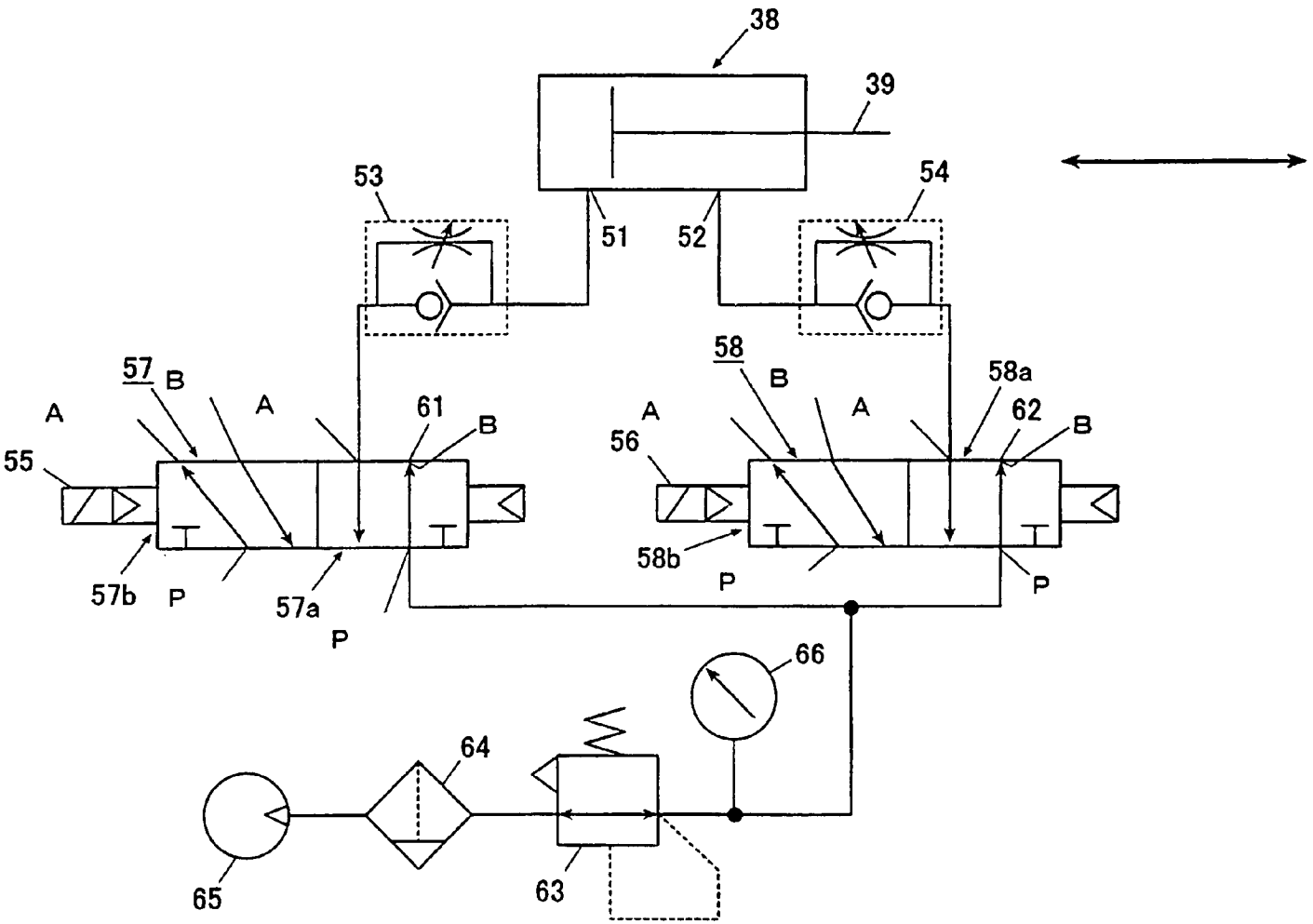
FIG. 5 is a pneumatic circuit diagram of the air cylinder shown in FIG. 3.

FIG. 5 is pneumatic circuit diagram with regard to the air cylinder 38. According to the first embodiment, the actuator is the air cylinder 38. As shown in FIG. 5, the air cylinder 38 is a cylinder of a one side rod type. Flow regulating valves 53, 54 each provided with check valves are respectively connected to an inlet/outlet port 51 on head side of the air cylinder 38 and an inlet/outlet port 52 on rod side of the air cylinder 38. A first and a second switching valves 57, 58 (electromagnetic valves) are respectively connected to the flow regulating valves 53, 54. Communicating portions of each of the first and the second switching valves 57, 58 are operable to be switched by single acting solenoids 55, 56. The first and the second switching valves 57, 58 are five-port pilot switching valves. By switching the communicating portions of the first switching valve 57, at either of the communicating portions 57*a*, 57*b*, a port A is communicated with the flow regulating valve 53, a port B is communicated with an exhaust port 61, and a port P is communicated with a compressed air source 65 via a pressure reducing valve 63 and a filter 64. By switching communicating portions of the second switching valve 58, at either of the communicating portions 58*a*, 58*b*, a port A is communicated with the flow regulating valve 54, a port B is communicated with an exhaust port 62, a port P is communicated with the compressed air source 65 via the pressure reducing valve 63 and the filter 64. A pressure meter 66 is installed between the pressure reducing valve 63 and the port P. Each of the exhaust ports 61, 62 is provided with a stop plug (not illustrated) in order to prevent compressed air from flowing out.

When the communicating portion of the first switching valve 57 is the communicating portion 57*a*, or when the communicating portion of the second switching valve 58 is the communicating portion 58*a*, the inlet/outlet port 51, or the inlet/outlet port 52 is opened to the atmosphere. Hereinafter, such a state of the switching valve is referred to as an opened state. On the other hand, when the communicating portion of the first switching valve 67 is the communicating portion 57*b*, or when the communicating portion of the second switching valve 58 is the communicating portion 58*b*, air from the compressed air source 65 flows into the air cylinder 38 via the flow regulating valve 53, or the flow regulating valve 54. Hereinafter, such a state of the switching valve is referred to as a flow-in state.

For example, when the first switching valve 57 is brought into the opened state and the second switching valve 58 is brought into the flow-in state, the piston rod 39 of the air cylinder 38 is rearwardly moved (a first state), whereby the presser foot 4 is moved up. When the first switching valve 57 is brought into the flow-in state and the second switching valve 58 is brought into the opened state, the piston rod 39 of the air cylinder 38 is forwardly moved (a second state), whereby the presser foot 4 moved down. When both the first switching valve 57 and the second switching valve 58 are brought into the opened state as shown in FIG. 5, the air cylinder 38 is brought into a neutral state, and the piston rod 39 of the air cylinder 38 is brought into a no-load state. In this way, the first and the second switching valves 57, 58 (switching portions) switch the state of the piston rod of the air cylinder 38 between the first state (the presser foot 4 is in a moved up state), the second state (the presser foot 4 is in a moved down state), and the no-load state (the air cylinder 38 is in the neutral state). In a case where a thickness of a cloth that is held between the presser foot 4 and the throat plate 2 varies, if the piston rod 39 of the air cylinder 38 is in the no-load state, a projecting amount of the piston rod 39 of the air cylinder 38 change freely in accordance with the thickness of the cloth since the lift lever 37 is connected to the holding bar 16.

Figure 6:
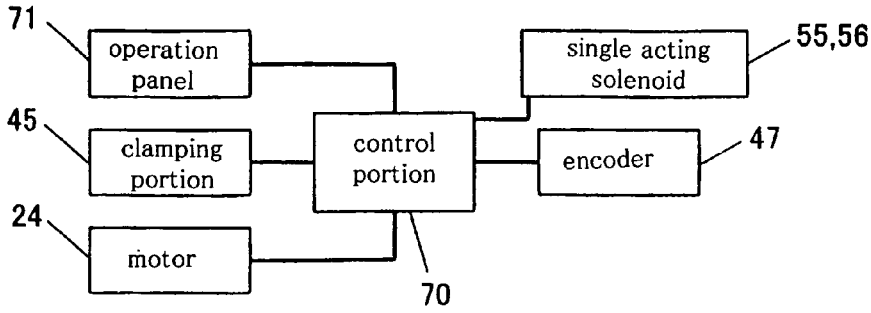
FIG. 6 is a block diagram showing a control constitution of the sewing machine shown in FIG. 1.

FIG. 6 is a block diagram showing a control constitution of the sewing machine 1. As shown in FIG. 6, the sewing machine 1 includes a control portion 70. The control portion 70 is electrically connected to an operation panel 71 to which various instructions are input, the clamping portion 45, the motor 24, the single acting solenoids 55, 56, and the encoder 47, and the control portion 70 controls the respective portions.

As shown in FIG. 1 through FIG. 3, when the control portion 70 controls the motor 24 in order to rotate the upper shaft 13, the needle bar 8 moves up and down via the eccentric cam 14 and the link 15. At the same time, also the rotating shaft 25 is rotated interlockingly with the upper shaft 13. A rotating power of the rotating shaft 25 is transmitted to the connecting member 19 via the transmission link 26 and the rotation link 27.

When the connecting member 19 is pushed to a right side shown in FIG. 2 by the rotation link 27, the supporting bar 9 and the upper feeding foot 3 move down. When the rotation link 27 is further pushed to the right side, the connecting member 19 rotates in a clockwise direction around the second connecting position 22 since the upper feeding foot 3 is grounded and cannot move down any more, whereby the holding bar 16 and the presser toot 4 are moved up.

Thereafter, when a oscillating direction of the rotation link 27 is reversed and the connecting member 19 is pulled back to the left side, the holding bar 16 and the presser foot 4 are moved down to be grounded on the workpiece. When the rotation link 27 is pulled back further to the left side, the connecting member 19 rotates in the counterclockwise direction around on the third connecting position 23 since the presser foot 4 is grounded and cannot move down further, whereby the supporting bar 9 and the upper feeding foot 3 are moved up. In this way, the presser foot 4 and the upper feeding foot 3 moves up and down substantially in opposite phases, alternately grounding and pressing the workpiece. The needle bar 8 moves up and down substantially in synchronization with the upper feeding foot 3.

As described above, the upper shaft 13 is also connected to the transmitting member 28 via an eccentric cam (not illustrated). The rotating power of the upper shaft 13 is transmitted to the transmitting member 28, the first lever 29, the second lever 30 in this order to oscillate the tension member 31 in a horizontal direction. By oscillating the tension member 31, the rotating frame 32 swings around a fulcrum at an upper end portion thereof, and the upper feeding foot 3 oscillates in the cloth feeding direction. In this way, the workpiece is fed in the cloth feeding direction by moving up and down the upper feeding foot 3 while being oscillated in the cloth feeding direction.

Figure 7:
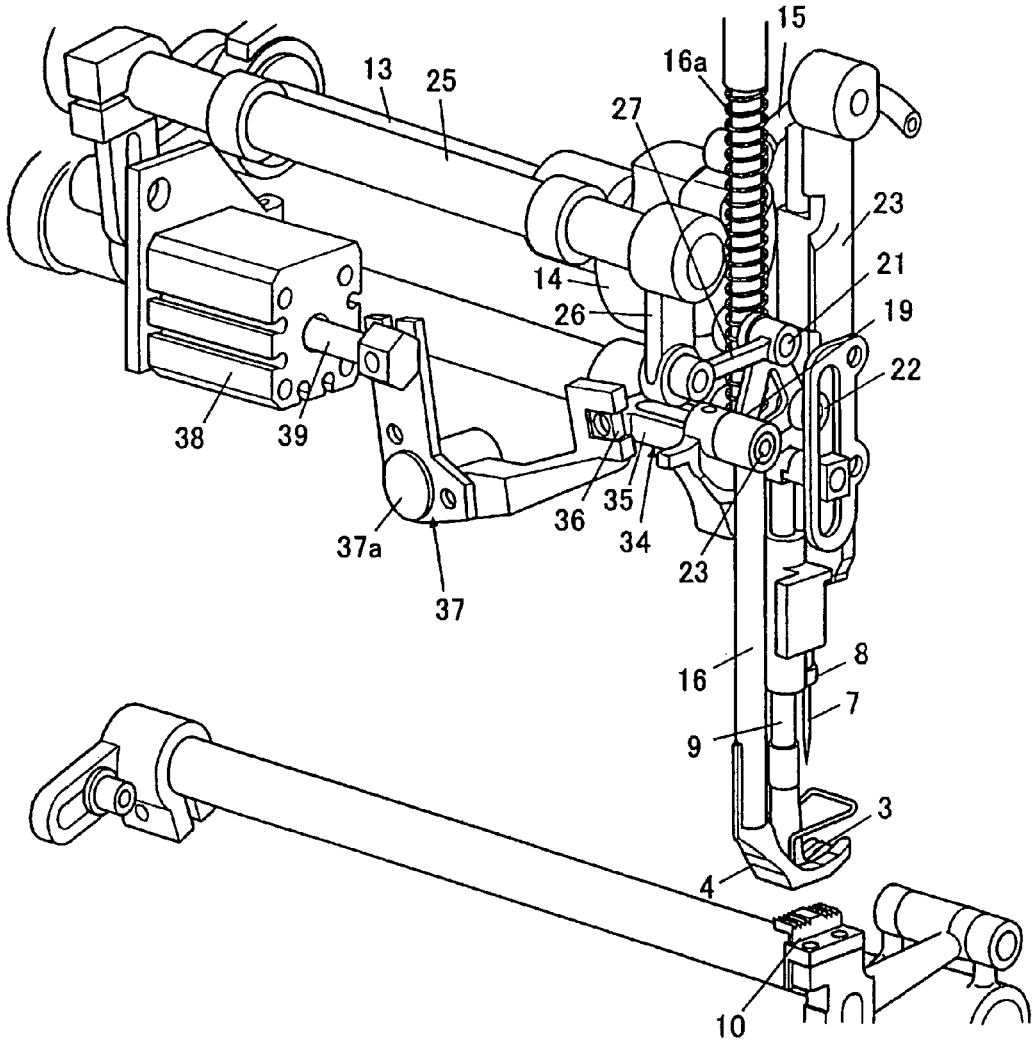
FIG. 7 is a perspective view showing a state in which a piston rod of the air cylinder shown in FIG. 3 is rearwardly moved.

As shown in FIG. 7, when the control portion 70 controls the single acting solenoids 55, 56 of the first and the second switching valves 57, 58, and the piston rod 39 of the air cylinder 38 is rearwardly moved by air from the compressed air source 65, the lift lever 37 is rotated in the counterclockwise direction shown in FIG. 7. In this way, the coupling member 34 and the connecting member 19 are moved up, and also the upper feeding foot 3 and the presser foot 4 connected to the connecting portion 19 are moved up (the moved up state). Thereafter, as shown in FIG. 3, when the control portion 70 controls the single acting solenoids 55, 56 of the first and the second switching valves 57, 58 to move forward the piston rod 39 of the air cylinder 38, the lift lever 37 is rotated in the clockwise direction shown in FIG. 3. In this way, the coupling member 34 and the connecting member 19 are moved down, and also the upper feeding foot 3 and the presser foot 4 connected to the connecting member 19 are moved down (moved down state). Here, when the control portion 70 controls the single acting solenoids 55, 56 of the first and the second switching valves 57, 58 to bring the air cylinder 38 into the neutral state, the piston rod 39 is not applied with a load, that is, the piston rod 39 is brought into the no-load state.

The control portion 70 detects an angle just before the upper thread 43 penetrating through the workpiece is caught by the shuttle 46 (an angle just before being caught) from a rotational angle of the upper shaft 13 obtained by the encoder 47.

When the control portion 70 detects the angle just before being caught, the control portion 70 controls the clamping portion 45 to clamp the upper thread 43 just before the upper thread 43 is caught by the shuttle 46 at a first stitch of a sewing operation. At this time, the control portion 70 also controls the single acting solenoids 55, 56 so as to move the piston rod 39 of the air cylinder 38 rearward by a predetermined time period and bring the presser foot 4 into the moved up state, and thereafter, to bring the air cylinder 38 into the neutral state.

Figure 8:
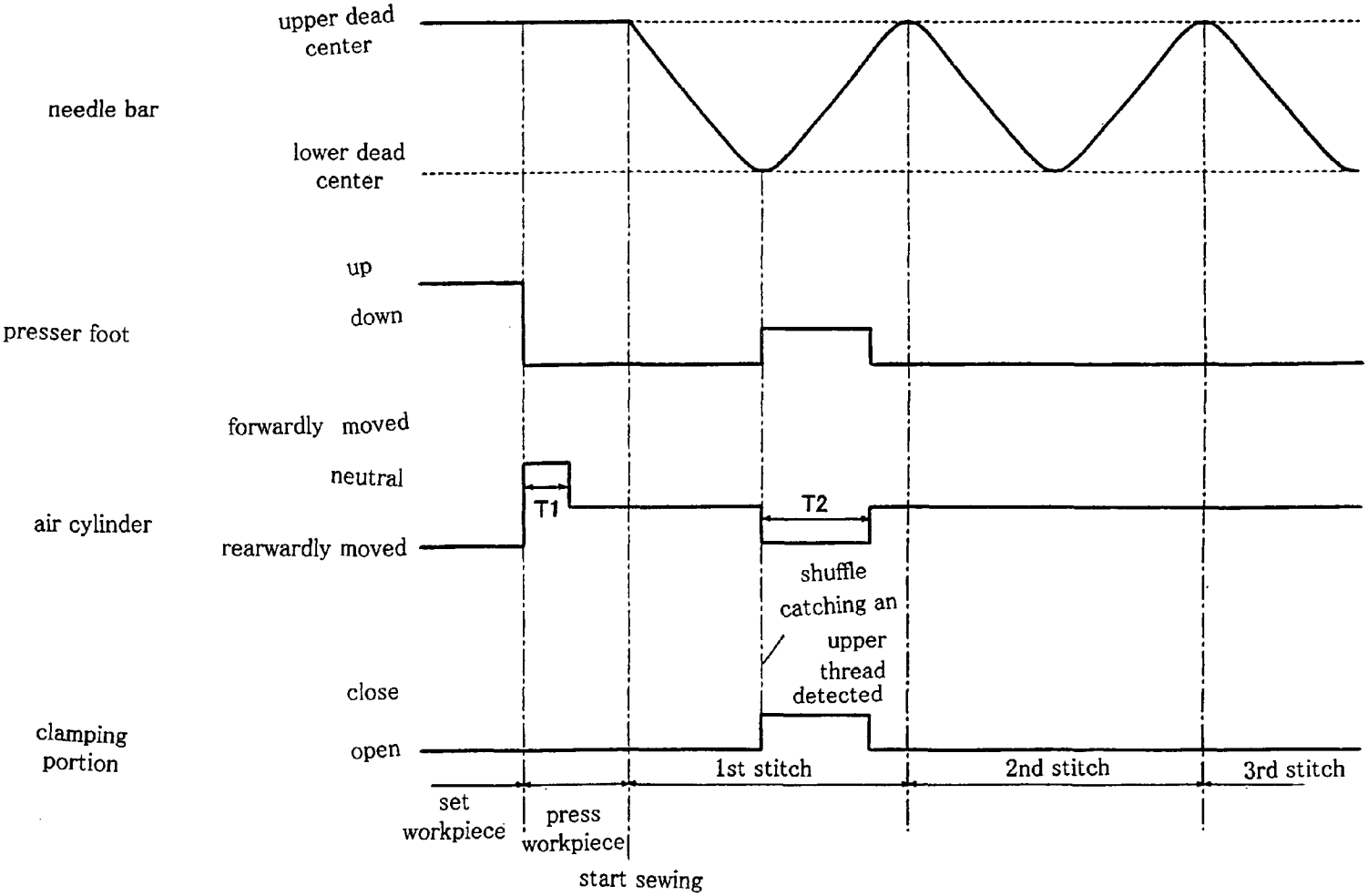
FIG. 8 is a timing chart showing an example of an operation of the sewing machine shown in FIG. 1.

More specific explanation will be given of operational timings of the sewing machine 1 with reference to a timing chart shown in FIG. 8. First, when the workpiece is set on the throat plate 2, the control portion 70 controls the single acting solenoids 55, 56 to move the piston rod 39 of the air cylinder 38 rearward and move the supporting bar 9 and the holding bar 26 up, thereby moving up the upper feeding foot 3 and the presser foot 4 (the moved up state) in a state in which the motor 24 is stopped. Whereby, a gap is produced between the upper feeding foot 3 as well as the presser foot 4 and the throat plate 2 so that a user inserts the workpiece into the gap.

After setting the workpiece, when a pressing instruction is input to the operation panel 71 by the user in order to press the workpiece, the control portion 70 controls the single acting solenoids 55, 56 to move the piston rod 39 of the air cylinder 38 forward by a predetermined time period T1, and to move the supporting bar 9 and the holding bar 16 down, thereby moving down the upper feeding foot 3 and the presser foot 4 (the moved down state). Whereby, the supporting rod 9 is brought into a interlocking state with the needle bar 8, and the presser foot 4 presses the workpiece. After the predetermined time period T1, the control portion 70 controls the single acting solenoids 55, 56 to bring the air cylinder 38 into the neutral state. Therefore, the piston rod 39 of the air cylinder 38 is brought into the no-load state, and the piston rod 39 is positioned to be projected in an amount that corresponds to the height of the holding bar 16 in accordance with the thickness of the cloth, via connecting portion including the coupling member 34, the lift up lever 37.

Thereafter, when an instruction of starting a sewing operation is input from the operation panel 71, the control portion 70 controls the motor 24 to rotate the upper shaft 13, thereby starting to sewing. In a first stitch, when the rotational angle of the upper shaft 13 obtained by the encoder 47 becomes the angle just before being caught, the control portion 70 controls the clamping portion 45 to clamp the upper thread 43 by a predetermined time period T2. Further, the control portion 70 controls the single acting solenoids 55, 56 to move the piston rod 39 of the air cylinder 38 rearward and to move the supporting bar 9 and the holding bar 16 up, thereby moving up the upper feeding foot 3 and the presser foot 4 (the moved up state) for a time period that is the same as the time period of clamping by the clamping portion 45. At this time, the upper thread 43 caught by the shuttle 46 is drawn by rotating the shuttle 46, and therefore, also the front end portion of the upper thread 43 is drawn to a back side of the workpiece, that is, inside the throat plate 2. Further, after the predetermined time period T2, the control portion 70 controls the single acting solenoids 55, 56 to continue the sewing operation while bringing the air cylinder 38 into the neutral state.

As described above, according to the sewing machine 1 of the first embodiment, the holding bar 16 and the air cylinder 38 are connected via the coupling member 34. Therefore, even when the thickness of the workpiece varies, the presser foot 4 properly presses the cloth, and therefore, it is not necessary to adjust an operational timing of moving up the presser foot 4 when starting the sewing operation.

Further, since the air cylinder 38 is brought into a neutral state except a predetermined section when starting the sewing operation, an operation of the first operating mechanism for reciprocating the presser foot 4 in the vertical direction is prevented from being hindered.

Therefore, despite a simple constitution in which a potentiometer is not used, the upper thread end can reliably be drawn to the back side of the cloth when starting a sewing operation.

The present invention is not limited to the first embodiment, and it is obvious that various changes and modification may be made therein.

For example, although the connecting member 19 is substantially in a triangular shape in the first embodiment, the connecting member may be formed in any shape so far as the connecting member moves the upper feeding foot 3 and the presser foot 4 synchronizingly up and down in opposite phases. A modified example of the first embodiment will be explained in reference to FIGS. 9, 10 as follows. Portions that are the same as those of the sewing machine of the first embodiment are attached with the same notations, and an explanation thereof will be omitted.

Figure 9:
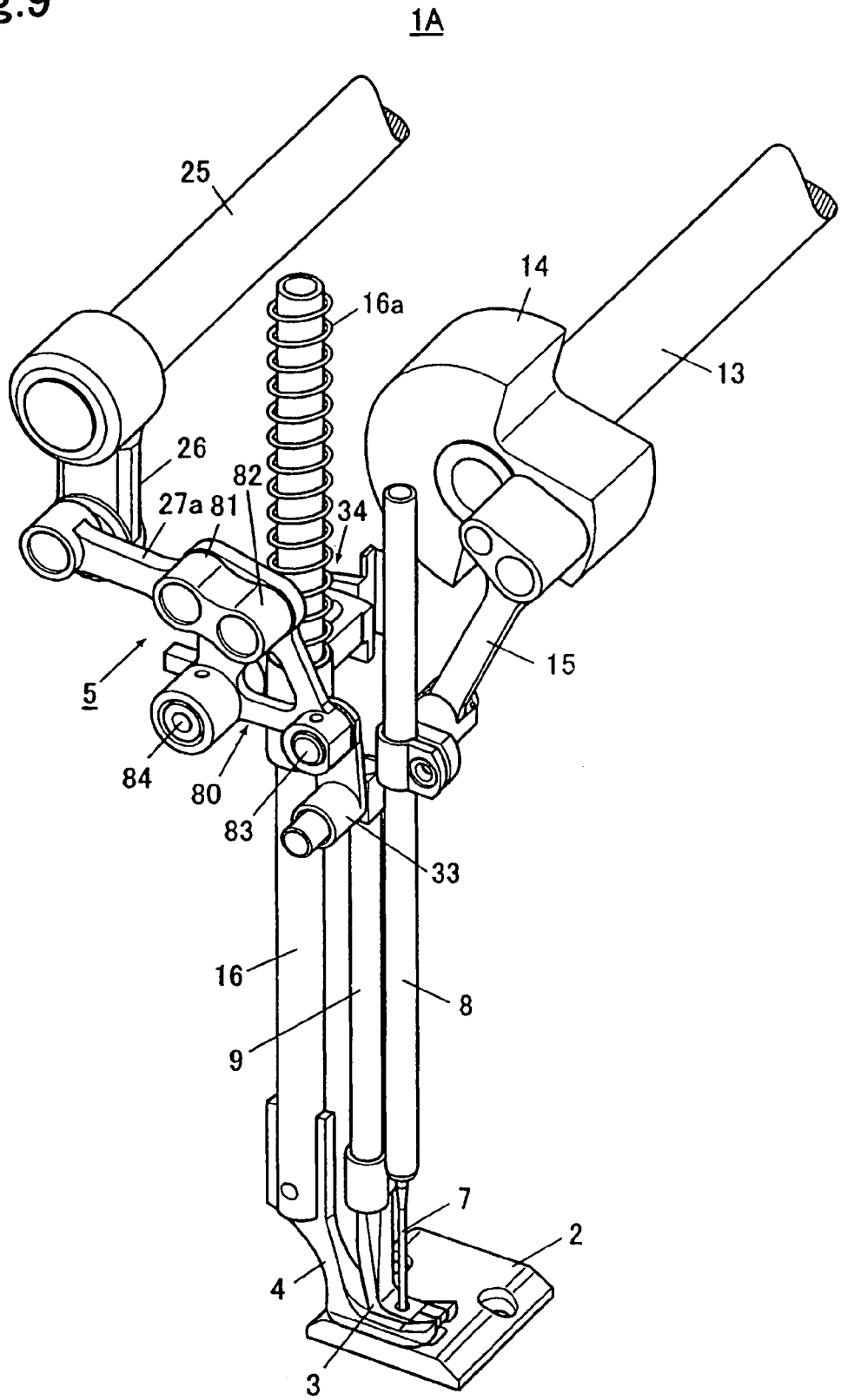
FIG. 9 is a perspective view showing a modified example of the sewing machine shown in FIG. 1.

According to a sewing machine 1A shown in FIG. 9, a connecting member 80 is formed substantially in a quadrangular shape. Two apex portions disposed at an upper portion of the connecting member 80 are a first and a second connecting position 81, 82. The first and the second connecting positions 81, 82 are fixed to one end portion of a rotation link 27*a* the other end portion of which is connected to a transmission link 26. Two fixing holes are formed at the end portion of the rotation link 27*a*, and each of the connecting positions 81, 82 engages with the respective fixing holes.

Of two apex portions disposed at a lower portion of the connecting member 80, an apex portion disposed on a downstream side in the cloth feeding direction is a third connecting position 83, and an apex portion disposed on an upstream side thereof is a fourth connecting position 84. The third connecting position 83 is connected to the supporting bar 9 via the link member 33, and the fourth connecting position 84 is connected to the holding bar 16 via the coupling member 34.

Figure 10:
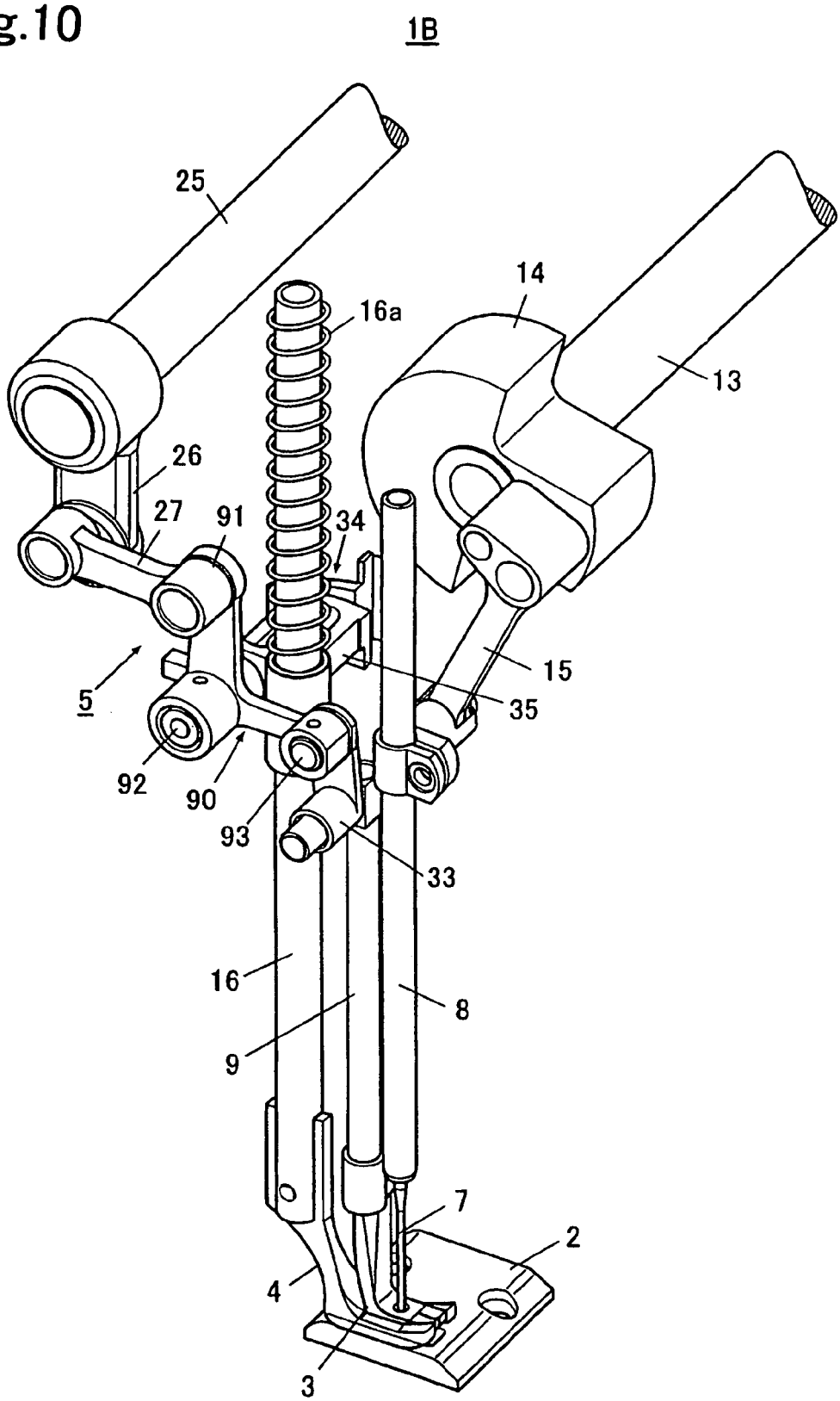
FIG. 10 is a perspective view showing another modified example of the sewing machine shown in FIG. 1.

Further, in a sewing machine 1B shown in FIG. 10, a connecting member 90 is formed substantially in an L-shape. One apex portion disposed at an upper portion of the connecting member is a first connecting position 91. The first connecting position 91 is fixed to one end portion of the rotation link 27 the other end portion of which is connected to the transmission link 26. A corner portion disposed at a lower portion of the connecting member 90 is a second connecting position 92, and an apex portion disposed on a downstream side of the second connecting position 92 is a third connecting position 93. The second connecting position 92 is connected to the holding bar 26 via the coupling member 34, and the third connecting position 93 is connected to the supporting rod 9 via the link member 33.

As described above, the connecting members 80, 90 having shapes other than the triangular shape can be applied in the present invention.

Second Embodiment

Next, a second embodiment of the invention will be explained. In the following explanation, portions that are the same as those of the sewing machine 1 of the first embodiment are attached with the same notations, and an explanation thereof will be omitted.

Figure 11:
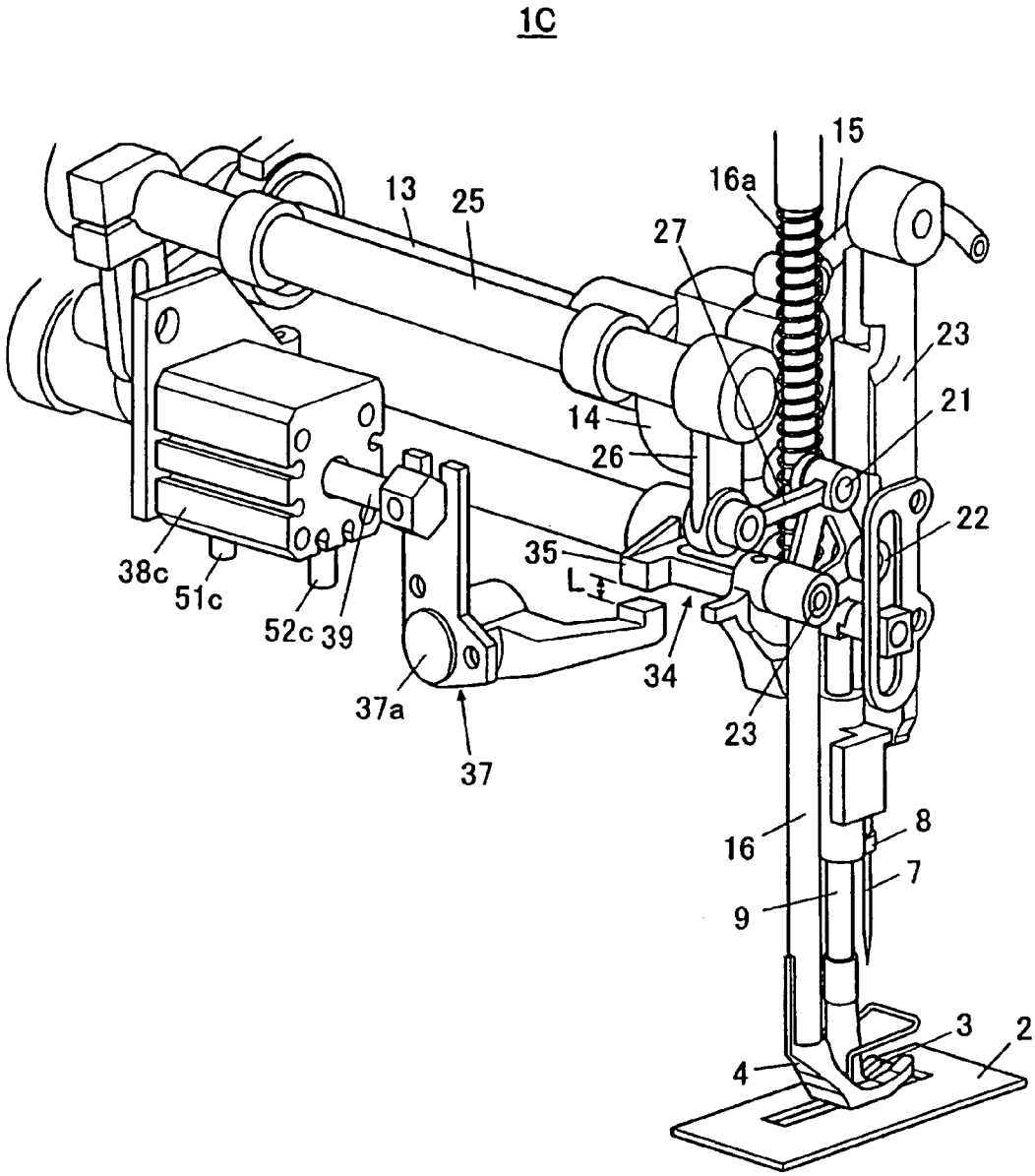
FIG. 11 is a perspective view showing a vicinity of an air cylinder of a sewing machine according to a second embodiment.

FIG. 11 is a perspective view showing a sewing machine 1C according to the second embodiment. As shown in FIG. 11, one end portion a lift lever 37*c* of the sewing machine 1C is separated from an extended portion 35 of the coupling member 34. By rotating the lift lever 37*c*, the one end portion and the extended portion 35 are brought into contact with each other or separated from each other.

Figure 12:
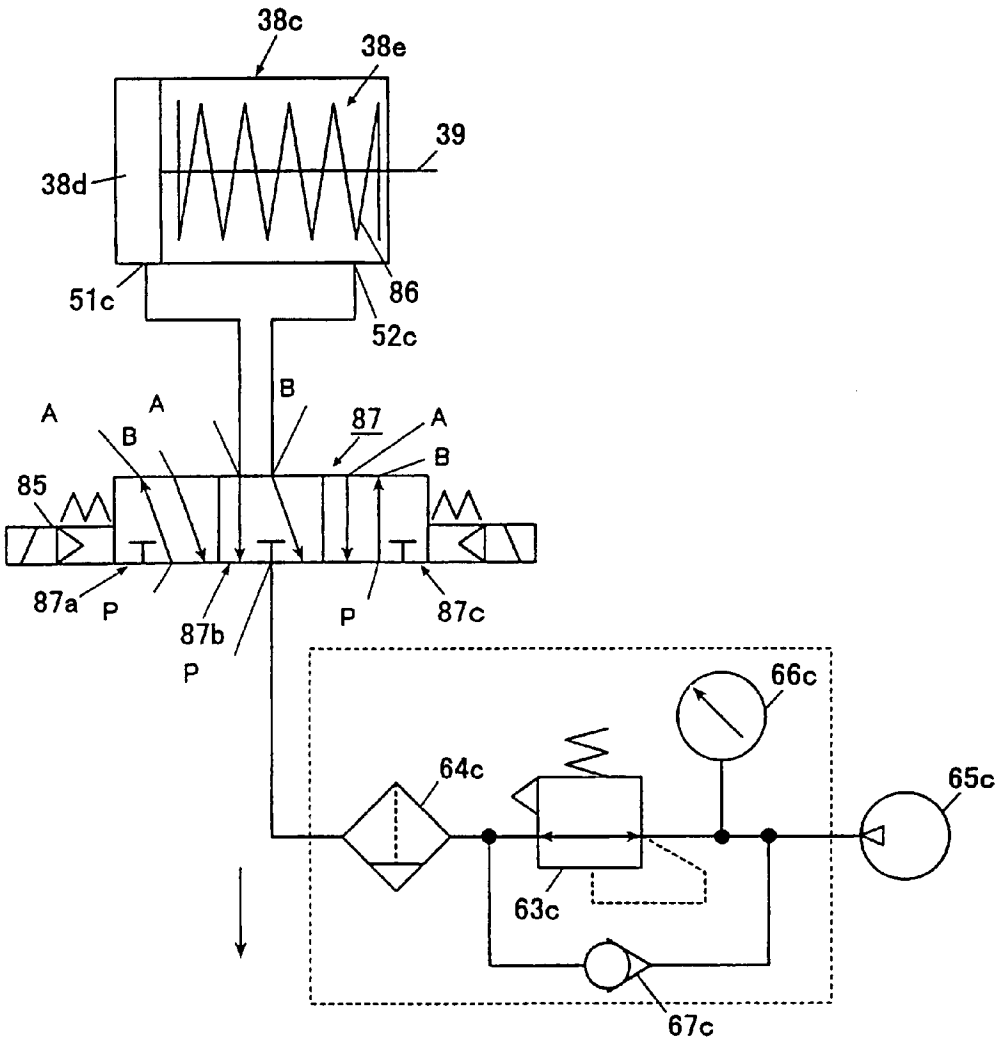
FIG. 12 is a pneumatic circuit diagram of the air cylinder shown in FIG. 11.

FIG. 12 is a pneumatic circuit diagram with regard to an air cylinder 38*c*. As shown in FIG. 12, the air cylinder 38*c* is a cylinder of a one side rod type. Inside a space 38*e* on rod side of the air cylinder 38*c*, a spring 86 as a biasing member operable to bias the piston rod 39 in a rearward direction is housed. An inlet/outlet port Sic on a head side of the air cylinder 38*c* and an inlet/outlet port 62*c* on a rod side thereof are connected to a switching valve 87, communicating portions of which are operable to be switched by a solenoid 85. The switching valve 87 is a five-port pilot switching valve of three-position type. By switching the communicating portions of the switching valve 87, at either of the communicating portions 87*a*, 87*b*, 87*c*, a port A is communicated with the head side inlet/outlet port 51*c*, a port B is communicated with the rod side inlet/outlet port 52*c*, a port P is communicated with a compressed air source 65*c* via a pressure reducing valve 63*c* and a filter 64*c*. The pressure reducing valve 63*c* is communicated with a pressure meter 66*c*, and a check valve 67*c*.

Figure 13:
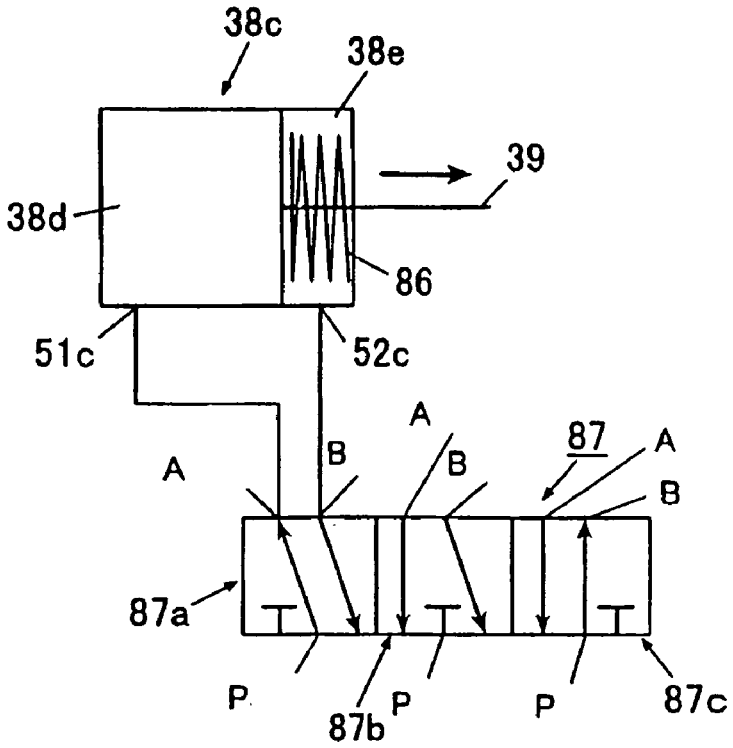
FIG. 13 is a pneumatic circuit diagram showing a forwardly moved state of the air cylinder shown in FIG. 12.

When the communicating portion of the switching valve 87 is the communicating portion 87*a*, the air from the compressed air source 65 flows into a space 38*d* on the head side of the air cylinder 38*c* via the inlet/outlet port Sic. In this case, the piston rod 39 is forwardly moved (second state), and the air inside the space 38*e* on the rod side is exhausted from the port B (see, FIG. 13). Such a state of the air cylinder is referred to a forwardly moved state.

Figure 14:
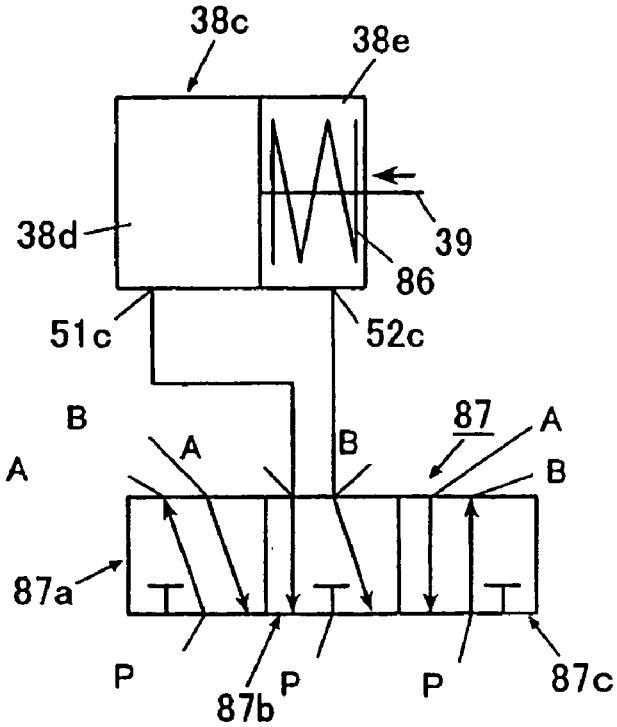
FIG. 14 is a pneumatic circuit diagram showing a neutral state of the air cylinder shown in FIG. 12.

When the communicating portion of the switching valve 87 is the communicating portion 87*b*, the air from the compressed air source 65 is shut off at the port P, and air does not flow into the air cylinder 38*c*. In this case, the port A, the port B are opened to the atmosphere, and therefore, the spring 86 extends and moves the piston rod 39 rearward inside the air cylinder 38*c* (see, FIG. 14). Such a state of the air cylinder is referred to as a neutral state.

Figure 15:
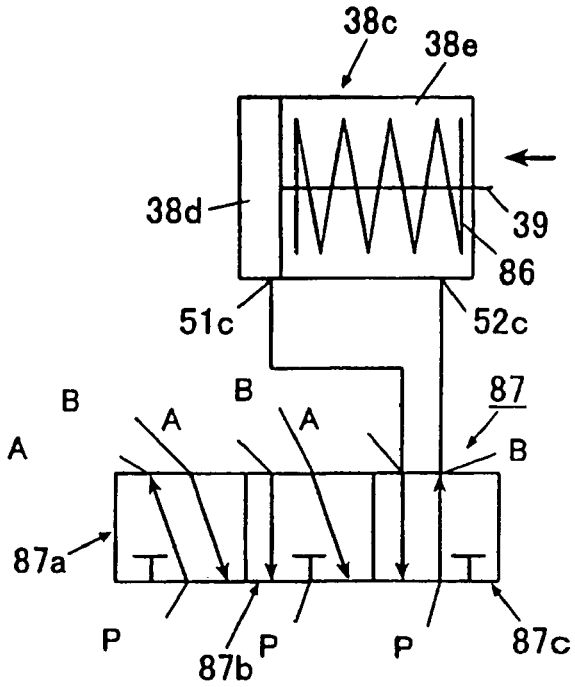
FIG. 15 is a pneumatic circuit diagram showing a rearwardly moved state of the air cylinder shown in FIG. 12.

When the communicating portion of the switching valve 87 is the communicating portion 87*c*, the air from the compressed air source 65 flows into the space 38*e* on the rod side of the air cylinder 38*c* via the inlet/outlet port 52*c*. In this case, the piston rod 39 is rearwardly moved (a first state), and the air inside the space 38*d* on the head side is exhausted from the port A (see, FIG. 15). Such a state of the air cylinder is referred to as a rearwardly moved state (the presser foot is brought into a moved up state).

The control portion 70 is connected to an operating pedal (not illustrated). The control portion 70 controls the respective driving portions based on instructions from the operating pedal and the operation panel 71.

As shown in FIG. 11, when the control portion 70 controls the solenoid 85 of the switching valve 87 to bring the air cylinder 38*c* into a forwardly moved state by the air from the compressed air source 65, the left lever 37*c* rotates in a clockwise direction shown in FIG. 11 in accordance with the piston rod 39 moving forward. Whereby, the coupling member 34 and the connecting member 19 are moved down, and also the upper feeding foot 3 and the presser foot 4 connected to the connecting member 19 are moved down (a moved down state).

Figure 16:
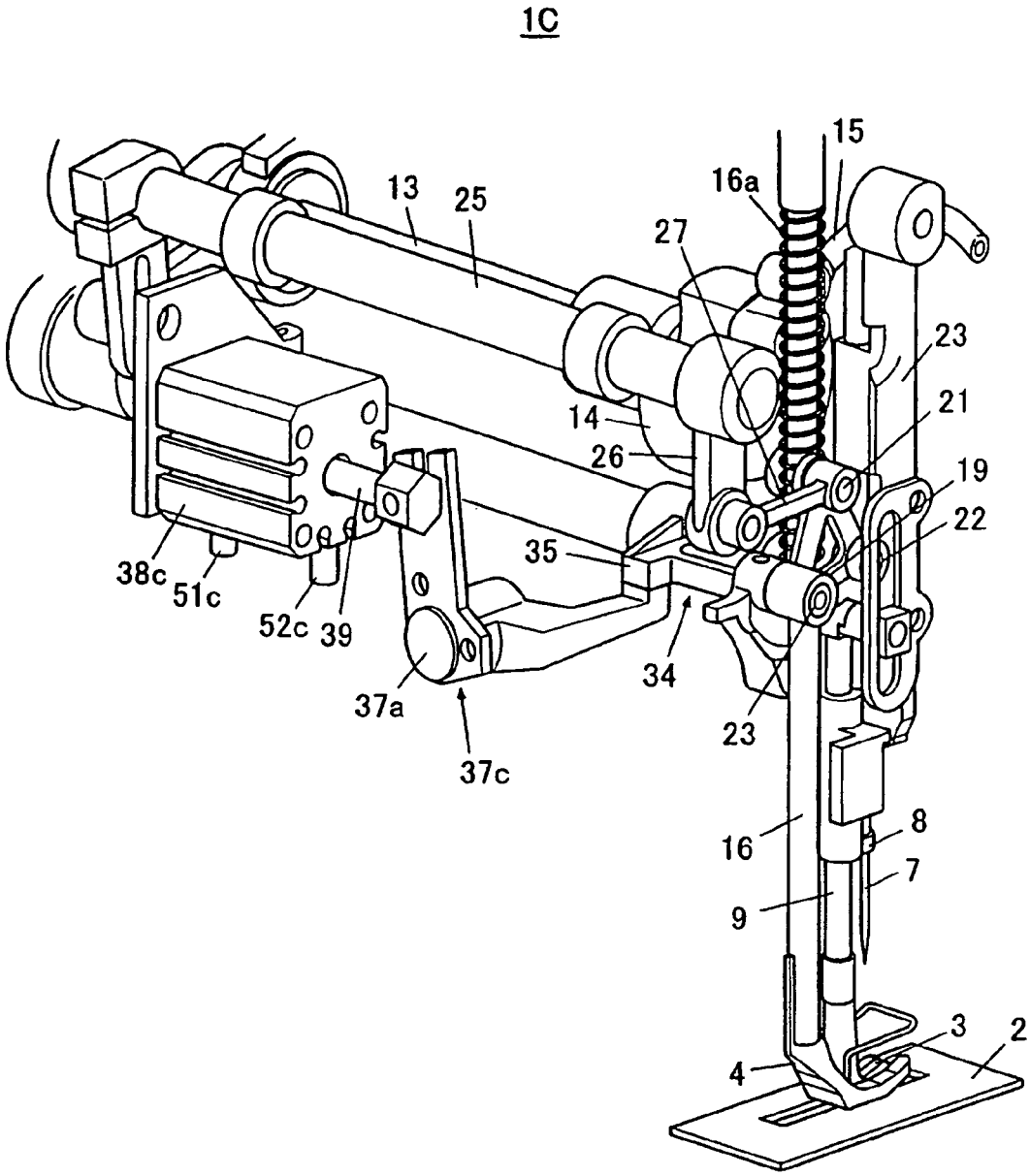
FIG. 16 is a perspective view showing a restricted state of a biasing member shown in FIG. 11.

Thereafter, as shown in FIG. 16, when the control portion 70 controls the solenoid 85 of the switching valve 87 to bring the air cylinder 38*c* into the neutral state, the piston rod 39 is rearwardly moved by a biasing force (a second biasing force) of the spring 86, and the lift lever 38*c* rotates in the counterclockwise direction shown in FIG. 16. Due to the biasing force of the spring 86, even when the thickness of the cloth of the cloth held by the presser foot 4 and the throat plate 2 varies, so far as the air cylinder 38*c* is brought into a neutral state, a gap L between the coupling member 34 of the holding bar 16 and the one end portion of the lift lever 37*c* is compensated.

The gap L is arranged in a transmission path between the air cylinder 38*c* and the presser foot 4. The transmission path is a path through which a power of the air cylinder 38*c* is transmitted to the presser foot 4. According to the second embodiment, the transmission path starts from one end portion of the piston rod 39 of the air cylinder 38*c* to the holding bar 16 via the lift lever 37*c*. The spring 86 (a biasing member) disposed on the transmission path applies a biasing force (the second biasing force) in a direction of filling the gap L. The biasing force (the second biasing force) of the spring 86 is set such that a biasing force (a first biasing force) of the spring 16*a* applied to the upper feeding foot 3 and the presser foot 4 is larger than the biasing force applied to the upper feeding foot 3 and the presser foot 4 from the lift lever 37*c*. Therefore, even when one end portion of the lift lever 37*c* is brought into contact with the extended portion 35 in the neutral state of the air cylinder 38*c*, the coupling member 34 and the connecting member 19 do not move up, and the upper feeding foot 3 and the presser foot 4 are restricted from being moved up (a restricted state of the biasing member).

Figure 17:
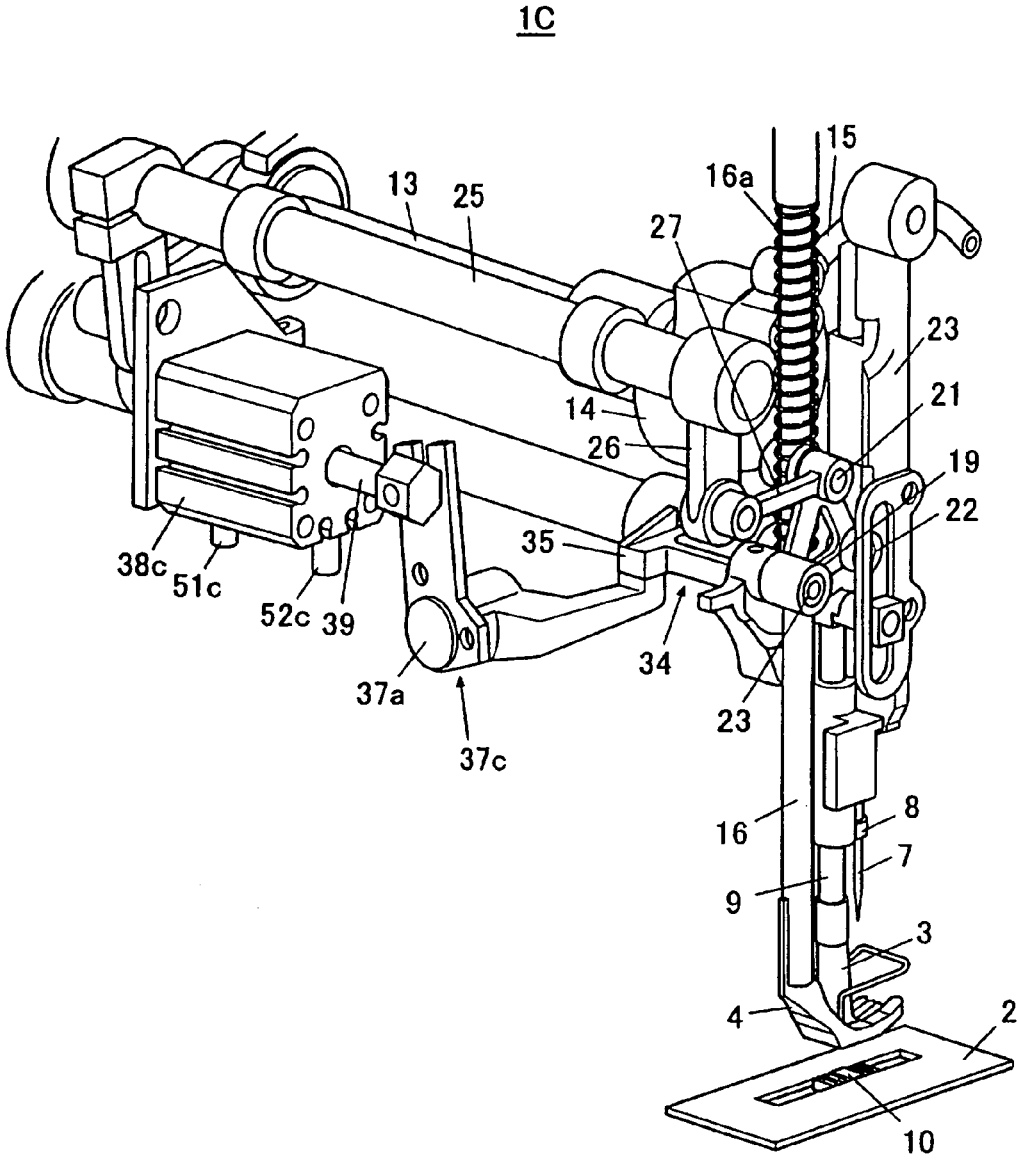
FIG. 17 is a perspective view showing a moved up state of a presser foot shown in FIG. 11.

As shown in FIG. 17, when the control portion 70 controls the solenoid 85 of the switching valve 87 to bring the air cylinder 38*c* in a rearwardly moved state by the air from the compressed air source 65, the lift lever 37*c* rotates in the counterclockwise direction in accordance with the piston rod 39 moving rearward. Whereby, the coupling member 34 and the connecting member 19 are moved up and also the upper feeding foot 3 and the presser foot 4 connected to the connecting member 19 are moved up (the moved up state).

Further, the control portion 70 controls the solenoid 85, and brings the air cylinder 38*c* into the neutral state after pressing the workpiece by bringing the presser foot 4 into the moved down state by the air cylinder 38*c*. Thereafter, the control portion 70 detects the angle just before the upper thread 43 penetrating through the workpiece is caught by the shuttle 46 (an angle just before being caught) from the rotational angle of the upper shaft 13 obtained by the encoder 47. When the angle just before being caught is detected, the control portion 70 controls the clamping portion 45 to clamp the upper thread 43 by a predetermined time period just before the upper thread 43 is caught by the shuttle 46 when starting a sewing operation. At this time, the control portion 70 also controls the solenoid 85, and brings the air cylinder 38*c* into the rearwardly moved state and brings the presser foot 4 in the moved up state by a predetermined time period.

Further, the control portion 70 controls the air cylinder 38*c* such that the lift lever 37*c* is moved to a position at which the one end portion of the lift lever 37*c* does not interfere with the coupling member during the sewing operation. Specifically, the air cylinder 38*c* is brought into the forwardly moved state to separate the front end portion of the lift lever 37*c* from the extended portion 35 of the coupling member 34.

Figure 18:
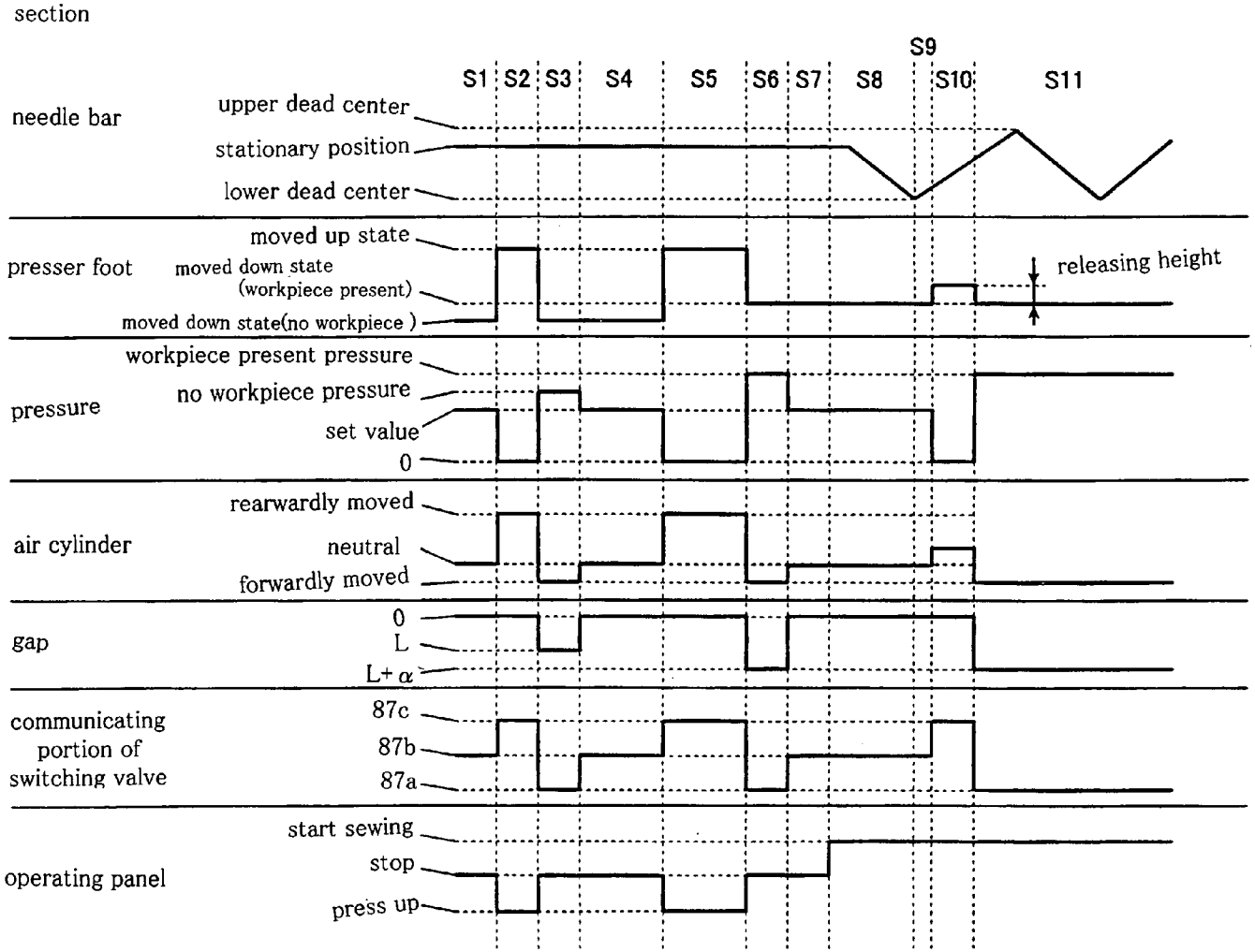
FIG. 18 is a timing chart of an operation of the sewing machine shown in FIG. 11.

Operational timings of the sewing machine 1C will be explained below with reference to the timing chart shown in FIG. 18. The timing chart assumes to start from a state in which the presser foot 4 is temporarily moved down after removing the workpiece when a thread is cut and the sewing machine 1C is stopped.

Section S1 of the timing chart is an initial state. The control portion 70 controls the solenoid 85 to communicate the communicating portion 87*b* of the switching valve 87 so as to bring the air cylinder 38*c* into the neutral state. Whereby, the needle bar 8 is disposed at a stationary position, the upper feeding foot 3 and the presser foot 4 are brought into the moved down state where there is no workpiece, a pressure of the presser foot 4 is at a set value (a pressure based on the spring 16*a*), and there is no gap L between the one end portion of the lift lever 37*c* and the extended portion 35.

Section S2 of the timing chart shows a state in which a press up instruction is input from the operating pedal when there is no workpiece. The control portion 70 controls the solenoid 85 to communicate the communicating portion 87*c* of the switching valve 87 to bring the air cylinder 38*c* into the rearwardly moved state. Whereby, the needle bar 8 is disposed at the stationary position, the upper feeding foot 3 and the presser foot 4 are brought into a state of being moved to highest positions, there is no pressure of the presser foot 4, and there is no gap L between the one end portion of the lift lever 37*c* and the extended portion 35. Thereafter, when a stop instruction is input, the control portion 70 moves on to section S3.

Section S3 of the timing chart shows a state in which the stop instruction is input. The control portion 70 controls the solenoid 85 to communicate the communicating portion 87*a* of the switching valve 87 and bring the air cylinder 38*c* into the forwardly moved state. Whereby, the needle bar 8 is disposed at a stationary position, and the presser foot 4 is brought into a moved down state when there is no workpiece.

At this time, the pressure of the presser foot 4 becomes a pressure where there is no workpiece, and the gap L is generated between the one end portion of the lift lever 37*c* and the extended portion 35.

Section S4 of the timing chart shows the state in which a predetermined time period elapsed after the gap L being generated where there is no workpiece. The control portion 70 controls the solenoid 85 to bring the air cylinder 38*c* into the neutral state by the switching valve 87, and brings the biasing member into a restricted state, which is similar to the state of section S1.

Section S5 of the timing chart shows a state in which a press up instruction is input from the operating pedal in order to set the workpiece. The control portion 70 controls the solenoid 85 to communicate the communicating portion 87*c* of the switching valve 87 to bring the air cylinder 38*c* into the rearwardly moved state, and brings the presser foot into the moved up state. Whereby, the needle bar 8 is disposed at the stationary position, the upper feeding foot 3 and the presser foot 4 are brought into a state of being moved up to highest positions, there is no pressure of the presser foot 4, and there is no gap L between the one portion of the lift lever 37*c* and the extended portion 35.

Section 36 of the timing chart of the state in which a stop instruction is input from the operating pedal after inserting the workpiece between the presser foot 4 as well as the upper feeding foot 3 and the throat plate 2. Although the operation per se is similar to that of section S3, the workpiece is inserted to between the presser foot 4 as well as the upper feeding foot 3 and the throat plate 2, and therefore, the presser foot 4 stops at a position of being moved up by an amount of the thickness of the workpiece. At this time, the coupling member 34 of the holding bar 16 connected to the presser foot 4 is not moved down by the amount of the thickness of the workpiece, and therefore, the gap L becomes larger (L+α) than that in the case in where there is no workpiece. When a predetermined time period is elapsed, the control portion 70 moves on to section S7.

Section S7 of the timing chart shows a state in which the predetermined time period is elapsed. The control portion 70 controls the solenoid 85 to communicate the communicating portion 87*b* of the switching valve 87, brings the air cylinder 38*c* into the neutral state, and brings the biasing member into the restricted state similar to the state of section S1. At this time, although the coupling member 34 of the holding bar 16 is not moved down by the amount of the thickness of the workpiece, the piston rod 39 of the air cylinder 38*c* is rearwardly moved by the biasing force of the spring 86. Therefore, the one end portion of the lift lever 37*c* and the extended portion 35 are brought into contact with each other, and there is no gap therebetween.

Further, in section S7, since the biasing force of the spring 16*a* applied to the upper feeding foot 3 and the presser foot 4 is set to be larger than the biasing force of the spring 16 applied to the upper feeding foot 3 and the presser foot 4 from the lift lever 37*c*, the presser foot 4 is made to stay in contact with the upper face of the workpiece. However, since the biasing force of the spring 86 is applied to the presser foot 4 via the lift lever 37*c* and the holding bar 16, the pressure by the presser foot 4 is reduced by an amount of the biasing force.

Here, since the pressure value of the presser foot 4 is a value that is effective in starting a sewing operation, a reduction in a small pressure falls in a nonproblematic range at this stage before starting the sewing operation.

Section S8 of the timing chart shows a state in which an instruction to start sewing in input from the operating pedal The control portion 70 controls the motor 24 to move down the needle bar 8 from the stationary state to reach a lower dead center. In the meantime, the other portions are kept in a state of section S7.

Section S9 of the timing chart still shows a state in which an instruction to start sewing is input from the operating pedal. The control portion 70 detects a position, at which the needle bar 8 passes through the lower dead center and at which the shuttle 46 scoop the upper thread, from the rotational angle of the upper shaft 13 obtained by the encoder 47. Also during this section, the other portions are kept in a state of section S7.

Section S10 of the timing chart shows a state in which the upper thread 43 is being drawn. The control portion 70 controls the clamping portion 45 to clamp the upper thread 43 by a predetermined time period when the rotational angle of the upper shaft 13 obtained by the encoder 47 becomes the angle just before being caught. At this time, the upper thread 43 caught by the shuttle 46 is drawn in accordance with rotating the shuttle 46, and therefore, also the front end portion of the upper thread 43 is drawn to the back side of the workpiece, that is, inside the throat plate 2. In the meantime, the control portion 70 controls the solenoid 85 to bring the air cylinder 38*c* into the rearwardly moved state and bring the presser foot into the moved up state by the switching valve 87. Therefore, the upper thread 43 is smoothly drawn to the inner side of the throat plate without being stepped on by the upper feeding foot 3 or the presser foot 4.

Section S11 of the timing chart shows a state in which an amount of the upper thread drawn by the shuttle 46 exceeds a maximum point. The control portion 70 controls the solenoid 85 to bring the air cylinder 38*c* into the neutral state and bring the biasing member into a restricted state by the switching valve 87. Whereby, the needle bar 8 is disposed at the stationary position, and the presser foot 4 is brought into the moved down state where there is no workpiece. At this time, the pressure of the presser foot 4 becomes a pressure where there is no workpiece, and the gap L is generated between the one end portion of the lift lever 37*c* and the extended portion 35. The holding bar 16 moves down by the biasing force of the spring 16*a*, and therefore, the upper feeding foot 3 and the presser foot 4 are brought into a state of pressing the workpiece in which a normal sewing operation can be carried out. The control portion 70 continues the sewing operation until a thread cutting operation is carried out.

As described above, according to the second embodiment, when the air cylinder 38*c* is brought into the neutral state, the gap between the one end portion of the lift lever 37*c* and the coupling member 34 of the holding bar 16 is closed by the spring 86 (biasing means) in accordance with the thickness of the cloth. Therefore, even when the thickness of the workpiece varies, the gap between the one end portion of the lift lever 37*c* and the coupling member 34 changes. Whereby, the presser foot 4 properly presses the cloth having a various thickness, and it is not necessary to adjust the operational timings of moving up the presser foot 4 when starting a sewing operation.

When starting the sewing operation, the presser foot 4 is brought into the moved down state by the air cylinder 38*c*, and after pressing the workpiece, the air cylinder 38*c* is brought into the neutral state. When the shuttle 46 catches the upper thread 43 penetrating through the workpiece, the air cylinder 38*c* brings the presser foot 4 into the moved up state for the predetermined time period, and therefore, the presser foot 4 does not step on the upper thread 43, whereby the upper thread end can reliably be drawn to the back side of the cloth.

During the sewing operation, the lift lever 37*c* is moved to the position at which the one end portion of the lift lever 37*c* does not interfere with the coupling member 34 of the holding bar 16. Therefore, when the presser foot 4 reciprocates in the vertical direction, the coupling member 34 of the holding bar 16 and the lift lever 37*c* do not interfere with each other, and the reciprocating operation is prevented from being hindered.

Figure 19:
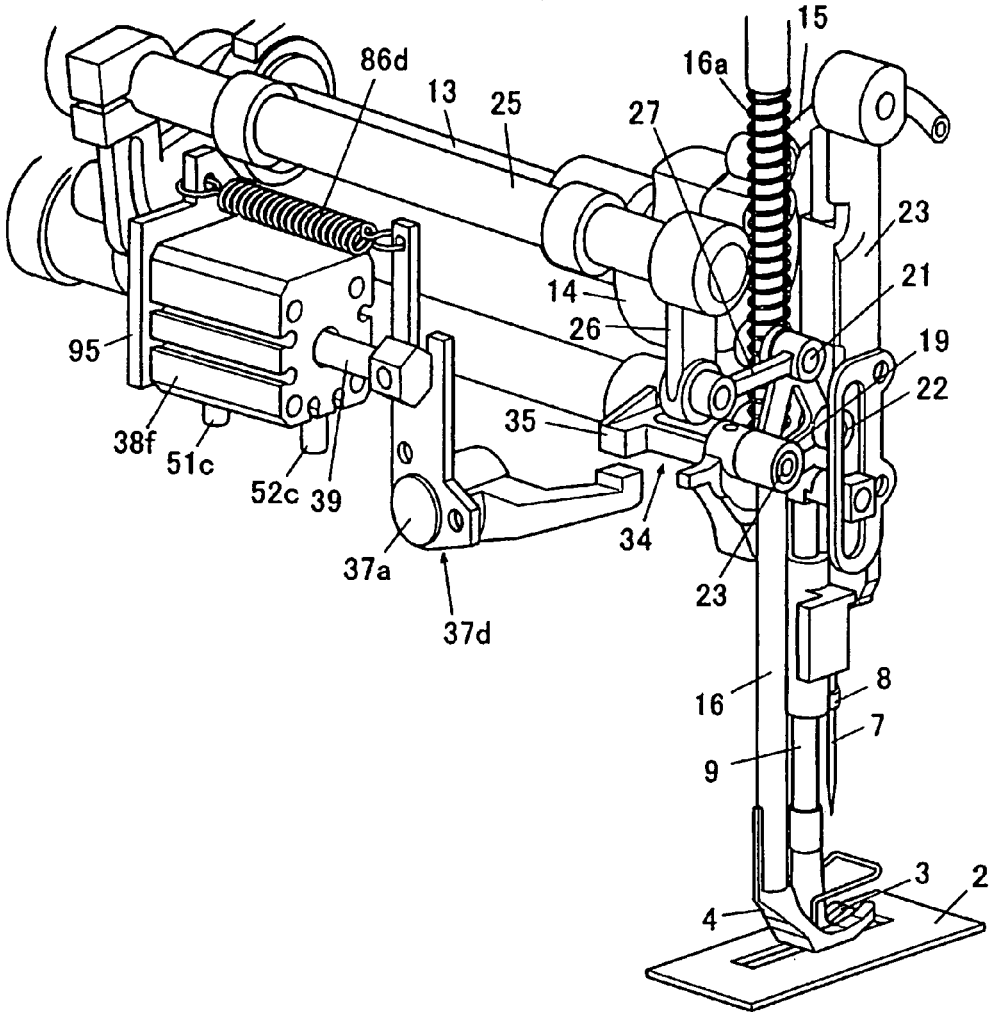
FIG. 19 is a perspective view showing a modified example of the sewing machine shown in FIG. 11.
Figure 20:
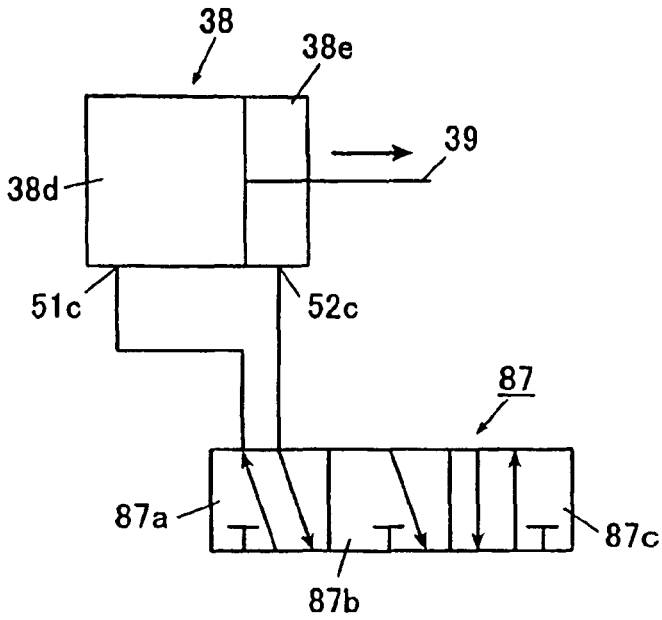
FIG. 20 is a pneumatic circuit diagram of the modified example of the sewing machine shown in FIG. 12.
Figure 21A:
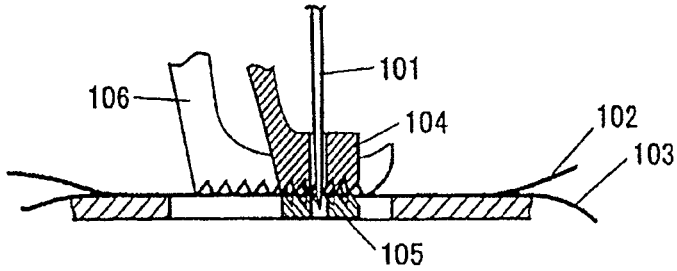
FIG. 21A through FIG. 21D are explanatory views showing operations of an upper feeding foot, a presser foot and feeding teeth when a workpiece is fed in a sewing machine of a related art.
Figure 21B:
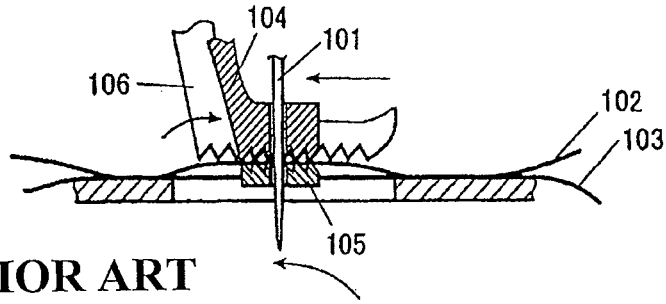
PRIOR ART Fig.21B
Figure 21C:
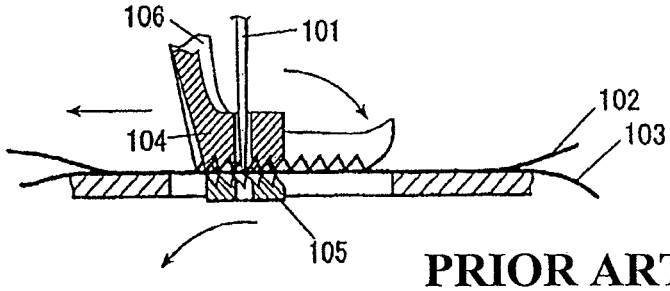
PRIOR ART Fig.21C
Figure 21D:
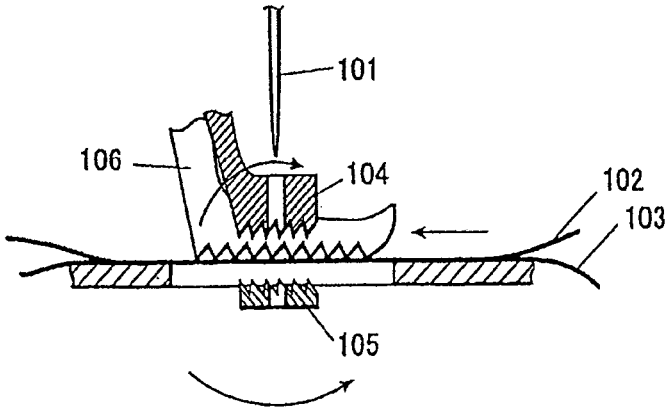
PRIOR ART Fig.21D
Figure 22:
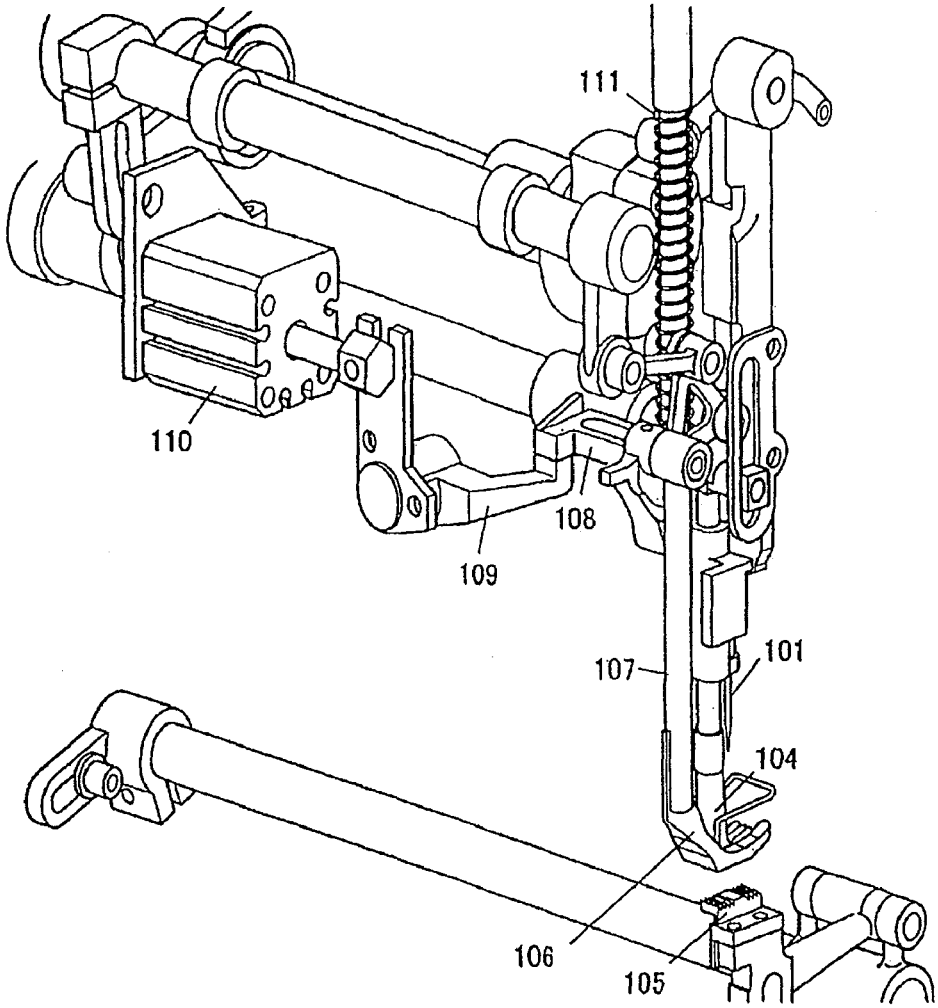
FIG. 22 is a perspective view showing a vicinity of a needle bar of the sewing machine of the related art shown in FIG. 21.
Figure 23:
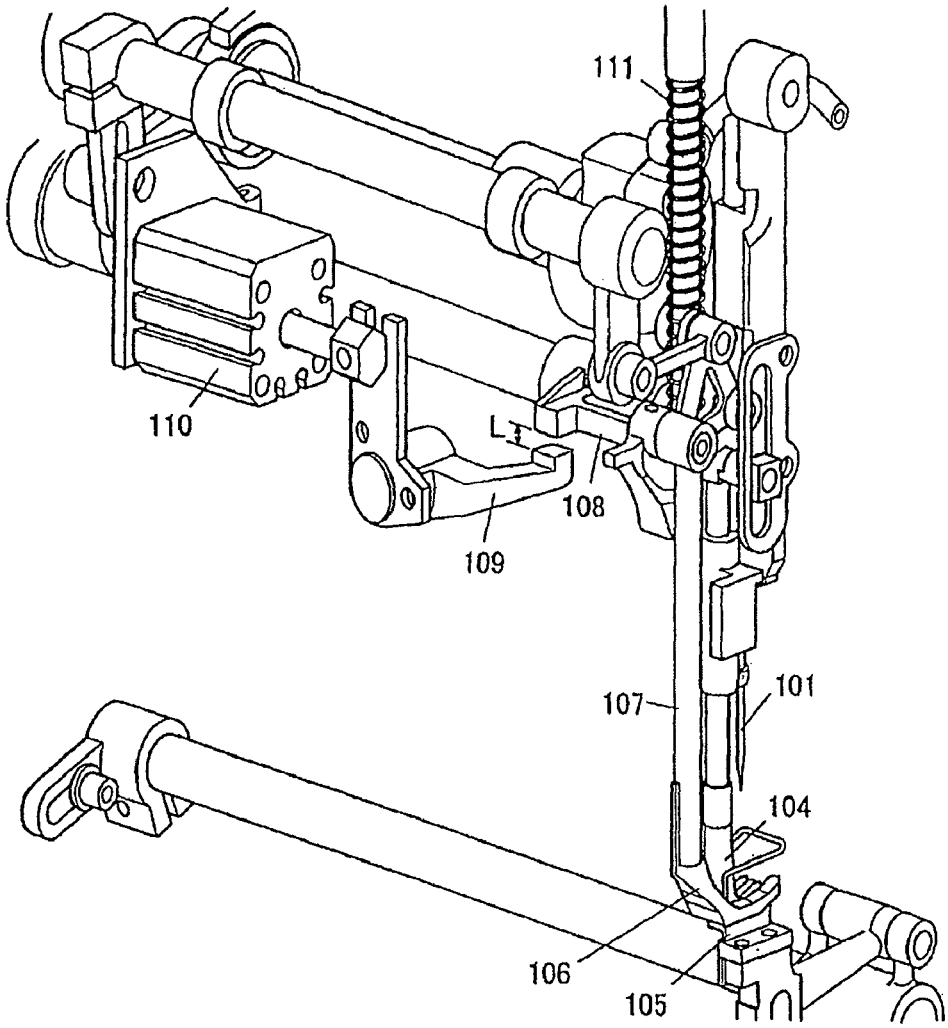
FIG. 23 is a perspective view showing a state in which a piston rod of the air cylinder is rearwardly moved in the sewing machine shown in FIG. 22.

The present invention is not limited to the second embodiment, and it is obvious that various changes and modification may be made For example, although the spring 86 as the biasing member is housed inside the air cylinder 38*c* in the second embodiment, the biasing member may be provided outside the air cylinder. FIG. 19 shows a perspective view showing an example of a case in which a spring 86*d* as a biasing member is arranged outside an air cylinder 38*f*. As shown in FIG. 19, the spring 86*d* is hung between a frame 95 at which a head side end portion of the air cylinder 38*f* is fixed, and other end portion of a lift lever 37*d* to be in line with a direction in which the air cylinder 38*f* is moved forward and rearward. Whereby, as shown in FIG. 20, even when the air cylinder 38*f* does not house a biasing member therein, in the neutral state, the spring 86*d* biases the lift lever 37*d* to move one end portion of the lift lever 37*d* in a direction of in which the holding rod 16 is moved up.

Further, although the holding bar 16 moves up and down via the coupling member 34 by rotating the lift lever 37*c* by the air cylinder 38*c* of a straight moving type in the second embodiment, the coupling member 34 may be moved up and down directly by the air cylinder by omitting the lift lever 37*c*. In this case, a piston rod of the air cylinder is arranged on an upper side or a lower side of the extended portion 35 by making a forward and rearward moving direction in line with the vertical direction to move up and down the extended portion 35 of the coupling member 34. In a case where the piston rod of the air cylinder arranged on the upper side, when the piston rod of the air cylinder and the extended portion 35 are not connected, the extended portion 35 cannot be moved up by the air cylinder. In case where the lift lever 37*c* is omitted, the air cylinder serves also as the lift lever according to the invention.

Further, the air cylinder may not be the air cylinder 38*c* of the straight moving type, but may be an air cylinder of a rotary type.

Although an explanation has been given by exemplifying the spring 86 as the biasing member in the second embodiment, other biasing member may be used. For example, there the biasing member applying the biasing force (the second biasing force) may be a magnet. More specifically, a magnet may be provided at either one end portion of the lift lever 37*c* or the coupling member 3, and other may be a magnetic member, whereby the one end portion of the lift lever 37*c* moves in the direction in which the holding bar 16 moves up. There may be employed an electromagnet that is operated only when starting a sewing operation. In such a configuration, the one end portion of the lift lever 37*c* and the coupling member 34 are separated from each other during the sewing operation, and therefore, interference can be prevented.

Further, although the piston rod 39 of the air cylinder 38 is connected to the holding bar 16 via the lift lever 37 in the first embodiment, a piston rod end of the straight moving type air cylinder may be directly be connected to the holding bar 16.

Further, although the piston rod 39 of the air cylinder 38*c* is connected to the lift lever 37*c*, and the one end portion of the lift lever 37*c* can be coupled to the holding bar 16 in the second embodiment, the piston rod of the air cylinder 38*c* may be brought into direct contact with the holding bar 16.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A sewing machine comprising:

a needle operable to penetrate a workpiece on a throat plate and operable to form a stitch with a shuttle;

a needle bar which supports the needle at a lower end thereof and operable to move up and down;

an upper feeding foot operable to contact with the workpiece from above and operable to feed the workpiece interlockingly with an up and down movement of the needle bar;

a presser foot operable to press the workpiece;

a holding bar which supports the presser foot at a lower end portion thereof, the holding bar being constantly biased downward by a first biasing force;

an upper shaft operable to drive the needle bar, the upper feeding foot, and the holding bar;

an actuator including an operating member operable to be changed to a first state, a second state or a no-load state; and a connecting portion which connects the operating member and the holding bar, wherein, independently from the upper shaft, the actuator moves the presser foot up against the first biasing force when the operating member is in the first state, and moves the presser foot down when the operating member is in the second state.

2. The sewing machine according to claim 1, further comprising:

a control portion operable to control the operating member, wherein, when a sewing starts, the control portion brings the operating member into the no-load state, and when the needle penetrates through the workpiece and forms a first stitch, the control portion brings the operating member into the first state for a predetermined time period, and thereafter, brings the operating member into the second state.

3. A sewing machine comprising:

a needle operable to penetrate a workpiece on a throat plate and operable to form a stitch with a shuttle;

a needle bar which supports the needle at a lower end thereof and operable to move up and down;

an upper feeding foot operable to contact with the workpiece from above and operable to feed the workpiece interlockingly with an up and down movement of the needle bar;

a presser foot operable to press the workpiece;

a holding bar which supports the presser foot at a lower end portion thereof, the holding bar being constantly biased downward by a first biasing force;

an actuator including an operating member operable to be changed to a first state, a second state or a no-load state;

a connecting portion operable to connect the operating member and the holding bar, and a gap is provided in a connecting path of the connecting portion;

and an biasing member which applies a second biasing force in a direction of reducing the gap, wherein the second biasing force is smaller than the first biasing force, the actuator moves the presser foot up against the first biasing force when the operating member is in the first state, and the presser foot is moved down by the first biasing force when the operating member is in the second state.

4. The sewing machine according to claim 3, further comprising:

a control portion operable to control the operating member, wherein, when a sewing starts, the control portion brings the operating member into the no-load state, and when the needle penetrates through the workpiece and forms a first stitch, the control portion brings the operating member into the first state for a predetermined time period, and thereafter, brings the operating member into the second state.

5. The sewing machine according to claim 3, wherein the biasing member includes an elastic member.

6. The sewing machine according to claim 1, wherein when the operating member is in the no-load state, the actuator is in a neutral state such that no load is applied to the operating member.

* * * * *